US009785073B2

(12) United States Patent
Kuroyama et al.

(10) Patent No.: US 9,785,073 B2
(45) **Date of Patent: *Oct. 10, 2017**

(54) TONER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Koichi Kuroyama, Kanagawa (JP); Tsutomu Katsumata, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 88 days.

This patent is subject to a terminal disclaimer.

(21) Appl. No.: 14/681,280

(22) Filed: Apr. 8, 2015

(65) Prior Publication Data

US 2015/0309435 A1 Oct. 29, 2015

(30) Foreign Application Priority Data

Apr. 25, 2014 (JP) ..... 2014-091827

(51) Int. Cl.

*G03G 9/097* (2006.01)
*G03G 9/087* (2006.01)
*G03G 9/08* (2006.01)

(52) U.S. Cl.

CPC ..... *G03G 9/08755* (2013.01); *G03G 9/08* (2013.01); *G03G 9/0819* (2013.01); *G03G 9/08782* (2013.01); *G03G 9/08795* (2013.01); *G03G 9/08797* (2013.01); *G03G 9/09725* (2013.01)

(58) Field of Classification Search

CPC ..... G03G 9/0755; G03G 9/08782; G03G 9/09725
USPC ..... 430/109.4, 108.4
See application file for complete search history.

(56) References Cited

U.S. PATENT DOCUMENTS

2006/0045571 A1* 3/2006 Matsuura ..... G03G 21/0064 399/149
2011/0281210 A1* 11/2011 Katsumata ..... G03G 9/081 430/108.4
2011/0281214 A1 11/2011 Kuroyama

FOREIGN PATENT DOCUMENTS

JP 8-050368 2/1996
JP 2011-237801 11/2011
WO WO-2013/137366 A1 * 9/2013

OTHER PUBLICATIONS

Japanese Office Action for Japanese Patent Application No. 2014-091827 dated May 23, 2017.
Japanese Office Action for Japanese Patent Application No. 2014-091827 dated May 30, 2017.

* cited by examiner

*Primary Examiner* — Janis L Dote
(74) *Attorney, Agent, or Firm* — Amin, Turocy & Watson LLP; Gregory Turocy

(57) ABSTRACT

A developer having low-temperature fixability and storage stability, and capable of prolonging the service life is provided. A toner includes a coloring agent, an amorphous polyester, a crystal line polyester, ester wax containing multiple ester compounds, each having a carbon number selected from 32 to 54, and hydrophobic silica having an average primary particle diameter of 8 to 35 nm. When the ion intensity ratio of each ester compound having a different carbon number is expressed as percentage, the content (a) of the ester compound having a carbon number of (Cn) showing the maximum intensity ratio is from 20 to 55% by weight of the entire ester wax, the sum (g) of the content (e) of the ester compound having a carbon number of (Cn+2) and the content (f) of the ester compound having a carbon number of (Cn+4) satisfies the following formula: $0.065 \leq g/a \leq 0.200$.

8 Claims, 4 Drawing Sheets

TONER

CROSS-REFERENCE TO RELATED APPLICATION

This application is based upon and claims the benefit of priority from Japanese Patent Application No. 2014-091827, filed Apr. 25, 2014, the entire contents of which are incorporated herein by reference.

FIELD

Embodiments described herein relate generally to a toner to be used for developing an electrostatic image or a magnetic latent image in an electrophotographic process, an electrostatic printing process, a magnetic recording process, or the like.

BACKGROUND

As a material constituting a toner to be used for forming an image, an ester wax having excellent fixability, particularly excellent high-temperature offset resistance, and a crystalline polyester resin having excellent low-temperature offset resistance are known. In recent years, in order to comply with energy efficiency standards in each country, which become stricter, the low-temperature fixation of a toner is demanded for reducing environmental burden.

For example, when an ester wax which has a small carbon number and shows a sharp intensity ratio distribution such that the ratio of the proportion of a carbon number showing the maximum intensity ratio to the proportion of the other carbon numbers is small is used, the low-temperature offset resistance is improved as compared with the case where a natural wax such as rice wax or carnauba wax is used. However, the storage property of the toner is deteriorated. On the other hand, when an ester wax which has a large carbon number and shows a sharp intensity ratio distribution of carbon numbers is used, since the straight chain of the ester wax is long, the low-temperature offset resistance is not excellent. By using this ester wax in combination with a crystalline polyester resin having excellent low-temperature offset resistance, the Tg of the toner is significantly lowered, so that the low-temperature offset can be improved.

In a toner using an ester wax which has a large carbon number and shows a sharp intensity ratio distribution of carbon numbers and a crystalline polyester in combination, a wax is deposited (bled out) on a toner surface when the toner is left under a high temperature and high humidity environment. Due to this, a carrier surface in a developer is contaminated with a wax component to deteriorate the chargeability during the service life, and therefore, toner scattering or fogging on an image is deteriorated so that it becomes hard to prolong the service life. By making the intensity ratio distribution of carbon numbers in the ester wax broader, and also by controlling the proportion of the ester wax having a small carbon number, the deposition of the wax when the toner is left under a high temperature environment can be suppressed.

However, even if a toner using an ester wax improved in this manner and a crystalline polyester in combination is mounted on a high-speed machine, the low-temperature fixation and the prolongation of the service life are further more demanded. If the proportion of components having a small carbon number in the ester wax is increased, the low-temperature fixation can be further achieved, however, the storage stability, which is an inconsistent object, is deteriorated. Moreover, the fluidity of the toner is deteriorated, resulting in the deterioration of toner scattering, and therefore, this method cannot achieve the prolongation of the service life. In this manner, it is very hard to achieve all of the low-temperature fixation in a high-speed machine, the storage stability, and the prolongation of the service life.

An object of the embodiments herein is to provide a toner having low-temperature fixability and storage stability, and capable of prolonging the service life.

According to an embodiment, a toner including: toner particles containing a coloring agent, an amorphous polyester, a crystalline polyester having an endothermic peak temperature of T2 as measured by a differential scanning calorimeter, and an ester wax having an endothermic peak temperature of T1 as measured by a differential scanning calorimeter (provided that $T1<T2$); and inorganic oxide particles externally added to the toner particles is provided. The ester wax contains multiple ester compounds, each having a carbon number selected from 32 to 54 and obtained by reacting an alkyl carboxylic acid component with an alkyl alcohol component, and when the ion intensity ratio of each ester compound having a different carbon number is expressed as percentage, the content (a) of the ester compound having a carbon number of (On) showing the maximum intensity ratio is from 20 to 55% by weight of the entire ester wax, and the content of the ester compounds having a carbon number of 38 or less is 10% by weight or less, of the entire ester wax. The sum (g) of the content (e) of the ester compound having a carbon number of (Cn+2) and the content (f) of the ester compound having a carbon number of (Cn+4) satisfies the following formula: $0.065 \leq g/a \leq 0.200$. The inorganic oxide particles contain hydrophobic silica having an average primary particle diameter of 8 to 35 nm.

DETAILED DESCRIPTION

Figure 1:
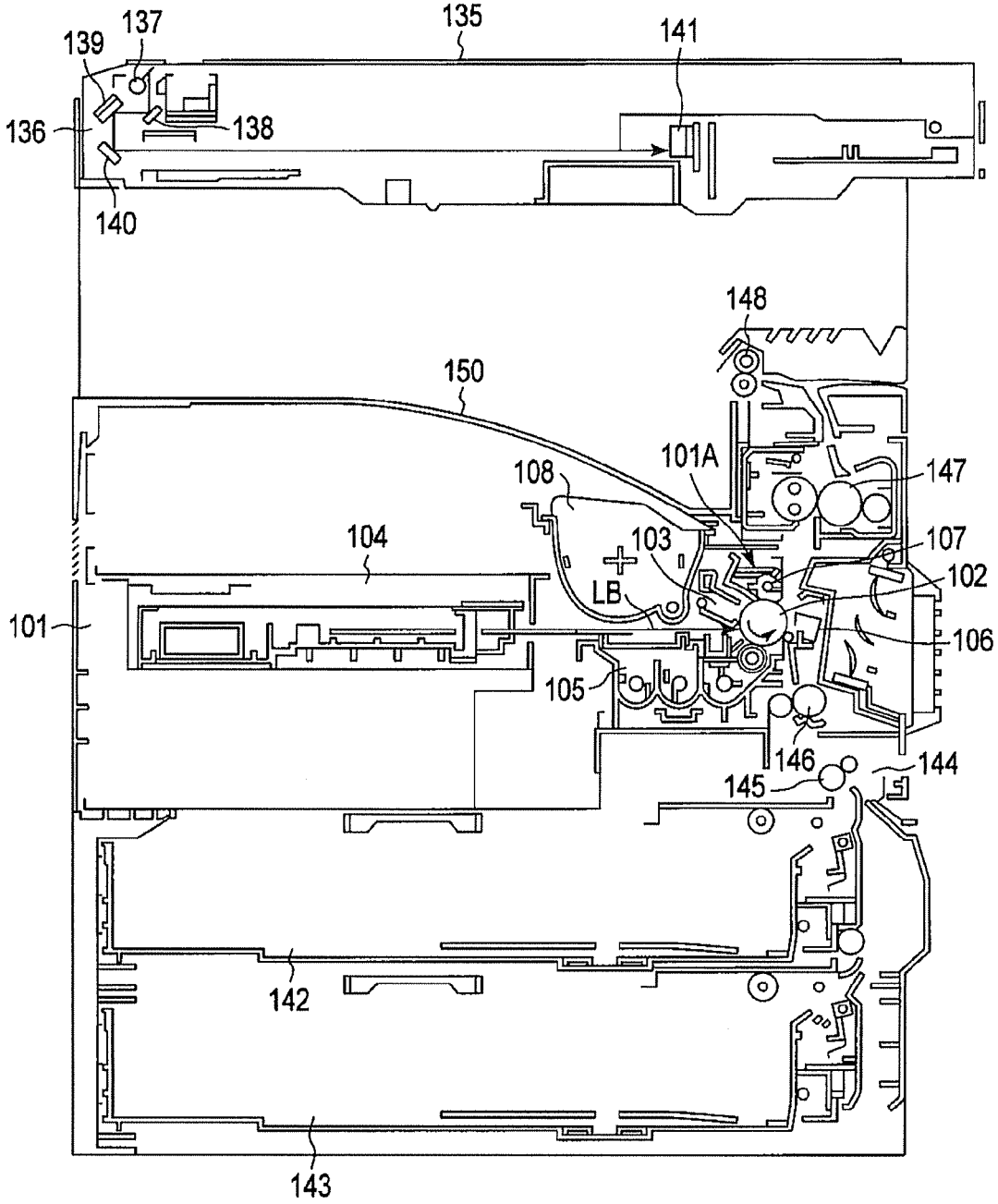
FIG. 1 is an internal structural view showing one example of an image forming apparatus.

Hereinafter, embodiments will be described.

A toner according to an embodiment includes toner particles containing a coloring agent, an amorphous polyester, a crystalline polyester, and an ester wax.

A polyester rein is used as a binder. In the embodiment, a polyester resin having a ratio of the softening point to the melting point (softening point/melting point) of 0.9 to 1.1 is referred to as "crystalline polyester resin", and a polyester resin other than this is referred to as "amorphous polyester".

As the starting material monomers of the polyester resin components, a dihydric or higher hydric alcohol component and a carboxylic acid component selected from a divalent or higher valent carboxylic acid, a carboxylic acid anhydride, a carboxylic acid ester, and the like are used.

Examples of the divalent alcohol component include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Preferred examples of the divalent alcohol component include bisphenol A-alkylene (having a carbon number of 2 or 3) oxide adducts (having an average addition molar number of 1 to 10), ethylene glycol, propylene glycol, 1,6-hexanediol, bisphenol A, and hydrogenated bisphenol A.

Examples of the trihydric or higher hydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Preferred trihydric or higher hydric alcohol components are, for example, sorbitol, 1,4-sorbitan, pentaerythritol, glycerol, trimethylolpropane, and the like.

In the embodiment, among these dihydric alcohols and trihydric or higher hydric alcohols, one alcohol can be used alone or multiple alcohols can be used in combination. However, in particular, a bisphenol A-alkylene (having a carbon number of 2 or 3) oxide adduct (having an average addition molar number of 1 to 10) can be used as a main component.

Examples of the divalent carboxylic acid component include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkenylsuccinic acids such as n-dodecenylsuccinic acid, alkylsuccinic acids such as n-dodecylsuccinic acid, and acid anhydrides or lower alkyl esters thereof.

Preferred divalent carboxylic acid components are maleic acid, fumaric acid, terephthalic acid, and succinic acid substituted with an alkenyl group having a carbon number of 2 to 20.

Examples of the trivalent or higher valent carboxylic acid component include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, enpol trimer acid, and acid anhydrides or lower alkyl esters thereof.

Preferred trivalent or higher valent carboxylic acid components are 1,2,4-benzenetricarboxylic acid (trimellitic acid) and acid anhydrides or alkyl (having a carbon number of 1 to 12) esters thereof, and the like.

In the embodiment, among these divalent carboxylic acids and trivalent or higher valent carboxylic acids, one carboxylic acid can be used alone or multiple carboxylic acids can be used in combination. In particular, fumaric acid, terephthalic acid, or succinic acid substituted with an alkenyl group having a carbon number of 2 to 20, each of which is a divalent carboxylic acid component, 1,2,4-benzenetricarboxylic acid (trimellitic acid), which is a trivalent or higher valent carboxylic acid component, or an acid anhydride or alkyl (having a carbon number of 1 to 12) ester thereof, or the like can be used as a main component.

When the starting material monomers of the polyester are polymerized, in order to accelerate the reaction, a usually used catalyst such as dibutyltin oxide, a titanium compound, a dialkoxytin (II), tin (II) oxide, a fatty acid tin (II), tin (II) dioctanoate, or tin (II) distearate can be appropriately used.

Examples of the acid component of the crystalline polyester resin to be used in the embodiment include adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, n-dodecylsuccinic acid, n-dodecenylsuccinic acid, cyclohexanedicarboxylic acid, trimellitic acid, pyromellitic acid, and acid anhydrides or alkyl (having a carbon number of 1 to 3) esters thereof. Among these, fumaric acid is preferred.

Examples of the alcohol component include ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, and trimethylolpropane. Among these, 1,4-butanediol and 1,6-hexanediol are preferred.

If the content of the crystalline polyester resin in the toner particles is too low, the low-temperature offset resistance tends to be deteriorated. On the other hand, if the content of the crystalline polyester resin is too high, the storage stability under a high temperature environment tends to be deteriorated. When the content of the crystalline polyester resin in the toner particles is in the range of 3 to 20% by weight, these disadvantages can be avoided.

If the endothermic peak temperature (T2) of the crystalline polyester as measured by a differential scanning calorimeter is too low, the storage stability tends to be deteriorated, and if the T2 is too high, the fixability tends to be poor. The endothermic peak temperature (T2) of the crystalline polyester as measured by a differential scanning calorimeter is preferably from 85 to 110° C.

The ester wax to be used in the embodiment is synthesized from a long-chain alkyl carboxylic acid and a long-chain alkyl alcohol component and contains multiple ester compounds having a different carbon number. The carbon number of each ester compound is selected from 32 to 54, and when the ion intensity ratio of each carbon number is expressed as percentage, the content (a) of the ester compound having a carbon number of (Cn) showing the maximum intensity ratio is from 20 to 55% by weight of the entire ester wax. Further, the content of the ester compounds having a carbon number of 38 or less is 10% by weight or less of the entire ester wax.

If the content (a) of the ester compound having a carbon number of (Cn) showing the maximum intensity ratio is too high, the wax is deposited when the toner is left under a high temperature environment so that the storage stability is deteriorated. Similarly, also if the content of the ester compounds having a small carbon number of 38 or less is too high, the wax is deposited when the toner is left under a high temperature environment so that the storage stability is deteriorated.

Incidentally, in rice wax, carnauba wax, or the like, the carbon number of a compound showing the maximum intensity ratio is large and the content of the compound is less than 20% by weight. In this manner, an ester wax having a broad intensity ratio distribution of carbon numbers has poor low-temperature fixability.

The content (a) of the ester compound having a carbon number of (Cn) showing the maximum intensity ratio is preferably from 20 to 50% by weight of the entire ester wax, and the content of the ester compounds having a carbon number of 38 or less is preferably 8% by weight or less of the entire ester wax. Further, the carbon number of (Cn) showing the maximum intensity ratio is preferably in the range of 40 to 48.

Further, in the ester wax to be used in this embodiment, the sum (g) of the content (e) of the ester compound having a carbon number of (Cn+2) and the content (f) of the ester compound having a carbon number of (Cn+4) preferably satisfies the following formula: $0.065 \leq g/a \leq 0.200$. If the ratio (g/a) is large, the content of the ester compounds having a carbon number larger than the carbon number showing the maximum intensity ratio is increased, and therefore, the low-temperature fixation is not excellent. Also if the ratio (g/a) is small, the dispersibility of the wax is deteriorated, so that the storage stability is deteriorated. The ratio (g/a) is more preferably 0.070 or more and 0.195 or less.

In addition, the sum d (d=b+c) of the content (b) of the ester compound having a carbon number of (Cn-4) and the content (c) of the ester compound having a carbon number of (Cn-2) satisfies the following formula: $0.619 \leq d/a \leq 0.783$. If the ratio (d/a) is large, the carbon number shows a broad distribution. This is advantageous to the low-temperature fixation, however, the dispersibility of the wax is deteriorated, and therefore, the storage stability is deteriorated. On the other hand, if the ratio (d/a) is small, the low-temperature fixation is not excellent. The ratio (d/a) is preferably 0.625 or more and 0.78 or less.

Further, the content (c) of the ester compound having a carbon number of (Cn-2) preferably satisfies the following formula: $0.281 \leq c/a \leq 0.518$. The ratio (c/a) more preferably satisfies the following formula: $0.29 \leq c/a \leq 0.51$.

The endothermic peak temperature (T1) of the ester wax as measured by a differential scanning calorimeter is lower than the endothermic peak temperature (T2) of the crystalline polyester as measured by a differential scanning calorimeter. If the endothermic peak temperature (T1) of the ester wax as measured by a differential scanning calorimeter is too high, the fixability tends to be deteriorated. The endothermic peak temperature (T1) of the ester wax as measured by a differential scanning calorimeter is preferably from 60 to 75° C.

In the ester wax to be used in this embodiment, the carbon number distribution satisfies given conditions as described above. Owing to this, the wax is favorably dispersed in the toner particles, and also the Tg of the toner is decreased, so that the fixability at a low temperature becomes favorable.

If the content of the ester wax in the toner particles is too low, both of the low-temperature offset resistance and the high-temperature offset resistance tend to be deteriorated, while on the other hand, if the content thereof is too high, the toner tends to adhere to a photoconductor or the storage stability of the toner under a high temperature environment tends to be deteriorated. When the ester wax accounts for 3 to 12% by weight of the toner particles, such disadvantages can be avoided.

As the coloring agent to be used in the embodiment, a carbon black, an organic or inorganic pigment or dye, or the like, which is used in a color toner, can be used. The type of the coloring agent in the embodiment is not particularly limited, however, as the carbon black, lamp black, acetylene black, furnace black, thermal black, channel black, ketjen black, aniline black (C.I. Pigment Black 6 and 7), or the like can be used.

Examples of the pigment or dye include Fast Yellow G, Benzidine Yellow, Chrome Yellow, Quinoline Yellow, Indofast Orange, Irgajin Red, Carmine FB, Permanent Bordeaux FRR, Pigment Orange R, Lithol Red 2G, Lake Red C, Rhodamine FB, Rhodamine B Lake, Du Pont Oil Red, Phthalocyanine Blue, Pigment Blue, Aniline Blue, Chalco Oil Blue, Ultramarine Blue, Brilliant Green B, Phthalocyanine Green, Malachite Green Oxalate, Methylene Blue Chloride, Rose Bengal, and Quinacridone (which are represented by C.I. Pigment Yellow 1, 12, 14, 17, 34, 74, 83, 97, 180, and 185, C.I. Pigment Orange 48 and 49, C.I. Pigment Red 5, 12, 31, 48, 48:1, 48:2, 48:3, 48:4, 48:5, 49, 53, 53:1, 53:2, 53:3, 57, 57:1, 81, 81:4, 122, 146, 150, 177, 185, 202, 206, 207, 209, 238, and 269, C.I. Pigment Blue 15, 15:1, 15:2, 15:3, 15:4, 15:5, 15:6, 75, 76, and 79, C.I. Pigment Green 1, 7, 8, 36, 42, and 58, C.I. Pigment Violet 1, 19, and 42, and C.I. Acid Red 52, respectively).

The above-described coloring agents can be used alone or in admixture.

Also, the addition amount of the coloring agent is not particularly limited, however, the coloring agent can be used in an amount of 4 to 15 parts by weight with respect to 100 parts by weight of the binder resin.

Further, a color developable compound and a color developing agent can be used in combination as the coloring agent.

The color developable compound is typified by a leuco dye and is an electron donating compound which can develop a color by the action of a color developing agent. Examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5, 6,7-tetrachlorophthalide. Additional examples thereof include pyridine compounds, quinazoline compounds, and bisquinazoline compounds.

The color developable compounds as described above may be used alone or by mixing two or more types thereof.

The color developing agent is an electron accepting compound which donates a proton to a leuco dye to cause the color developable compound to develop a color. Examples of the color developing agent include phenols, metal salts of phenols, metal salts of carboxylic acids, aromatic carboxylic acids, aliphatic carboxylic acids having 2 to 5 carbon atoms, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof. These compounds may be used by mixing two or more types thereof.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as 2,3-dihydroxybenzoic acid and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyflethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidynetrisphenol, 4,4'-(1-methylethylidene)bisphenol, and methylenetris-p-cresol.

A decoloring agent is contained as needed. As the decoloring agent, any known material can be used as long as the material inhibits the coloring reaction between the leuco dye and the color developing agent, thereby making a material colorless through heating in a three-component system containing the color developable compound, the color developing agent, and the decoloring agent.

In particular, a compound having a coloring and decoloring mechanism utilizing the thermal hysteresis of a known decoloring agent disclosed in JP-A-60-264285, JP-A-2005-1369, JP-A-2008-280523, or the like has an excellent instantaneous erasing property. When a mixture of such a three-component system in a colored state is heated to a specific decoloring temperature (Th) or higher, the mixture can be decolored. Further, even if the decolored mixture is cooled to a temperature of Th or lower, the decolored state is maintained. When the temperature of the mixture is further decreased, a coloring reaction between the leuco dye and the color developing agent is restored at a specific color restoring temperature (Tc) or lower so that the decolored mixture returns to the colored state. In this manner, it is possible to cause a reversible coloring and decoloring reaction. In particular, it is preferred that the decoloring agent to be used in the embodiment satisfies the following relationship: Th>Tr>Tc, wherein Tr represents room temperature.

Examples of the decoloring agent capable of causing this thermal hysteresis include alcohols, esters, ketones, ethers, and acid amides.

Particularly preferred are esters. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in each molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. As the decoloring agent, one type may be used alone or two or more types may be mixed and used.

When the color developable compound and the color developing agent as described above are used in combination, a decolorable toner can be obtained.

Examples of a charge control agent to be used in the embodiment include metal-containing azo compounds. As the metal element of the metal-containing azo compound, a complex or a complex salt of iron, cobalt, or chromium, or a mixture thereof can be used. Further, a metal-containing salicylic acid derivative compound or a hydrophobized metal oxide material can also be used, and as the metal element, a complex or a complex salt of zirconium, zinc, chromium, or boron, or a mixture thereof can be used. For example, a clathrate compound of a polysaccharide containing aluminum and magnesium can be used. Also the addition amount of the charge control agent is not particularly limited, but can be set to 0.5 to 3 parts by weight with respect to 100 parts by weight of the binder resin.

If the addition amount of the charge control agent is less than 0.5 parts by weight, the charging amount of the developer is decreased so that the toner scattering in the machine tends to be deteriorated during long service life. On the other hand, if the addition amount thereof exceeds 3 parts by weight, the charging amount of the developer is increased so that the image density is lacking or the contamination of the carrier surface in the developer is deteriorated, and thus, the chargeability tends to be unstable.

As a unit for mixing and dispersing starting materials, for example, as a mixing machine, a HENSCHEL MIXER (manufactured by MITSUI MINING CO., LTD.); a SUPER MIXER (manufactured by KAWATA MFG CO., LTD.); a RIBOCONE (manufactured by OKAWARA CORPORATION); a NAUTA MIXER, a TURBULIZER, and a CYCLOMIX (all of which are manufactured by HOSOKAWA MICRON CORPORATION); a SPIRALPIN MIXER (manufactured by PACIFIC MACHINERY & ENGINEERING CO., LTD.); and a LODIGE MIXER (manufactured by MATSUBO CORPORATION) can be exemplified. As a kneading machine, a KRC KNEADER (manufactured by KURIMOTO, LTD.); a BUSS KO-KNEADER (manufactured by BUSS AG); a TEM TYPE EXTRUDER (manufactured by TOSHIBA MACHINE CO., LTD.); a TEX TWIN-SCREW KNEADING MACHINE (manufactured by THE JAPAN STEEL WORKS, LTD.); a PCM KNEADING MACHINE (manufactured by IKEGAI LTD.); a THREE ROLL MILL, a MIXING ROLL MILL, and a KNEADER (all of which are manufactured by INOUE MFG., INC.); a KNEADEX (manufactured by MITSUI MINING CO., LTD.); an MS TYPE PRESSURE KNEADER and a KNEADER RUDER (both of which are manufactured by MORIYAMA COMPANY LTD.); and a BANBURY MIXER (manufactured by KOBE STEEL, LTD.) can be exemplified.

As a unit for coarsely pulverizing a mixture, for example, a hammer mill, a cutter mill, a jet mill, a roller mill, a ball mill, or the like can be used. As a pulverizer to be used for finely pulverizing the coarsely pulverized material, for example, a COUNTER JET MILL, a MICRON JET, and an INOMIZER (all of which are manufactured by HOSOKAWA MICRON CORPORATION); an IDS TYPE MILL and a PJM JET PULVERIZER (both of which are manufactured by NIPPON PNEUMATIC MFG. CO.); a CROSS JET MILL (manufactured by KURIMOTO, LTD.); an ULMAX (manufactured by NISSO ENGINEERING CO., LTD.); an SK JET-O MILL (manufactured by SEISIN ENTERPRISE CO.); a KRIPTRON (manufactured by KAWASAKI HEAVY INDUSTRIES, LTD.); and a TURBO MILL (manufactured by TURBO KOGYO CO., LTD.) can be exemplified.

As a classifying machine for classifying the finely pulverized material, for example, a CLASSIEL, a MICRON CLASSIFIER, and a SPEDIC CLASSIFIER (all of which are manufactured by SEISIN ENTERPRISES CO., LTD.); a TURBO CLASSIFIER (manufactured by NISSHIN ENGINEERING CO., LTD.); a MICRON SEPARATOR, a TURBOPLEX (ATP), and a TSP SEPARATOR (all of which are manufactured by HOSOKAWA MICRON CORPORATION); an ELBOW-JET (manufactured by NITTETSU MINING CO., LTD.); a DISPERSION SEPARATOR (manufactured by NIPPON PNEUMATIC MFG. CO., LTD.); and a YM MICROCUT (manufactured by YASUKAWA SHOJI K.K.) can be exemplified.

In the embodiment, in order to stabilize the fluidity, chargeability and storage property of the toner, an additive composed of inorganic oxide particles is added to the surfaces of the toner particles. The inorganic oxide can be selected from, for example, silica, titania, alumina, strontium titanate, tin oxide, and the like. If the volume average particle diameter of the particles composed of such an inorganic oxide is too small, the transfer efficiency of the toner onto a transfer belt or a paper is deteriorated. If the volume average particle diameter thereof is too large, a scratch occurs on a photoconductor. When the volume average particle diameter of the inorganic oxide particles is in the range of 8 to 200 nm, the transfer efficiency is not deteriorated, and also the occurrence of a scratch on a photoconductor can be avoided.

As the inorganic oxide particles, one type of inorganic oxide particles may be used alone or two or more types of inorganic oxide fine particles having different particle diameters may be mixed and used. As such inorganic oxide fine particles, those surface-treated with a hydrophobizing agent can be used from the viewpoint of improvement of environmental stability.

The inorganic oxide particles can be added in an amount of 0.2 to 7.0% by weight of the toner particles.

In particular, in this embodiment, the inorganic oxide particles contain hydrophobic silica having an average primary particle diameter of 8 to 35 nm. By this hydrophobic silica having a small particle diameter, the fluidity of the toner is increased. The average primary particle diameter of the hydrophobic silica is determined based on SEM observation. Specifically, with respect to different toners, five fields are observed by SEM at 50,000 magnification. At least 50 particles of hydrophobic silica having a major axis of around 5 to 40 nm are observed in the five fields, and the length of each of the major axis diameter and the minor axis diameter of silica in the toner is measured. The average of the measurements is determined as the average primary particle diameter.

If the amount of the hydrophobic silica having a small particle diameter is too small, the storage stability and the property of long service life tend to be deteriorated. When the hydrophobic silica having a small particle diameter is contained in an amount of 0.2 to 0.8% by weight of the toner particles, the effect thereof is exhibited.

Further, the hydrophobic silica is preferably in a non-spherical shape. The term "non-spherical shape" as used herein refers to that the ratio of the major axis diameter to the minor axis diameter is 1.1 or more and 3.0 or less, and the major axis diameter and the minor axis diameter can be determined by observing silica in the toner by SEM at 50,000 magnification. If the ratio of the major axis diameter to the minor axis diameter is less than 1.1, the shape of the hydrophobic silica is close to a true sphere and a contact area with the toner particles or other additives is small. Due to this, the hydrophobic silica is easily released from the toner particles. On the other hand, if the ratio of the major axis diameter to the minor axis diameter is larger than 3.0, the hydrophobic silica is in the shape of a rod or a needle, and the particle diameter also becomes larger. In either case, the fluidity of the toner is deteriorated so that the charge control becomes insufficient, and also toner scattering may be caused.

In the toner of this embodiment, hydrophobic silica having an average primary particle diameter of 8 to 35 nm is present in the inorganic oxide particles as an additive, and the hydrophobic silica having a small particle diameter is hardly released from the toner particles. Due to this, the fluidity of the toner can be improved.

In addition to the inorganic oxide fine particles as described above, resin fine particles having a size of 1 μm or less can be further added.

The additive composed of the inorganic oxide fine particles can be mixed with the toner particles using the mixing machine as described above.

As a sieving device to be used for sieving out coarse particles and the like, an ULTRA SONIC (manufactured by KOEI SANGYO CO.); a RESONA SIEVE and a GYRO SIFTER (both of which are manufactured by TOKUJU CORPORATION); a VIBRASONIC SYSTEM (manufactured by DALTON CO., LTD.); a SONICLEAN (manufactured by SHINTO KOGYO KABUSHIKI KAISHA); a TURBO SCREENER (manufactured by TURBO KOGYO CO., LTD.); a MICRO SIFTER (manufactured by MAKINO MFG. CO., LTD.); a circular vibrating sieve; and the like can be exemplified.

The toner particles can be prepared by, for example:

melt-kneading the materials of the toner particles, thereby forming a kneaded material;

pulverizing the formed kneaded material, thereby forming a coarsely granulated mixture;

mixing the coarsely granulated mixture with an aqueous medium, thereby preparing a dispersion liquid;

subjecting the dispersion liquid to mechanical shearing, thereby forming fine particles of the coarsely granulated mixture; and aggregating the fine particles in the dispersion liquid.

The toner of this embodiment can be used as a one-component developer or a two-component developer in combination with a carrier.

The developer of this embodiment has an excellent property of long service life as well as low-temperature fixability and storage stability, and therefore is favorably used as a recycled toner. That is, the toner can be reused in an image forming apparatus by recovering the toner after an image is formed and replenishing the developing device with the recovered toner.

One example of the image forming apparatus with which the recovered toner is reused will be described with reference to FIG. 1.

In FIG. 1, the reference numeral 101 denotes a copying machine main body, and an image forming section 101A is provided on one side of the central part in this copying machine main body 101. The image forming section 101A includes a photoconductive drum 102 as an image carrying body which is rotatable in the arrow direction. Around this photoconductive drum 102, an electrifying charger 103 which charges the surface of the photoconductive drum 102, a laser unit 104 as an image forming unit for forming an electrostatic latent image on the surface of the photoconductive drum 102, a developing device 105 as a developing unit for developing the electrostatic latent image on the photoconductive drum 102 with a toner, a transferring charger 106 as a transferring unit for transferring the toner image on the photoconductive drum 102 onto a paper, and a cleaning device 107 as a removing unit for removing a residual toner on the photoconductive drum 102 are sequentially arranged along the rotating direction of the photoconductive drum 102.

Figure 2:
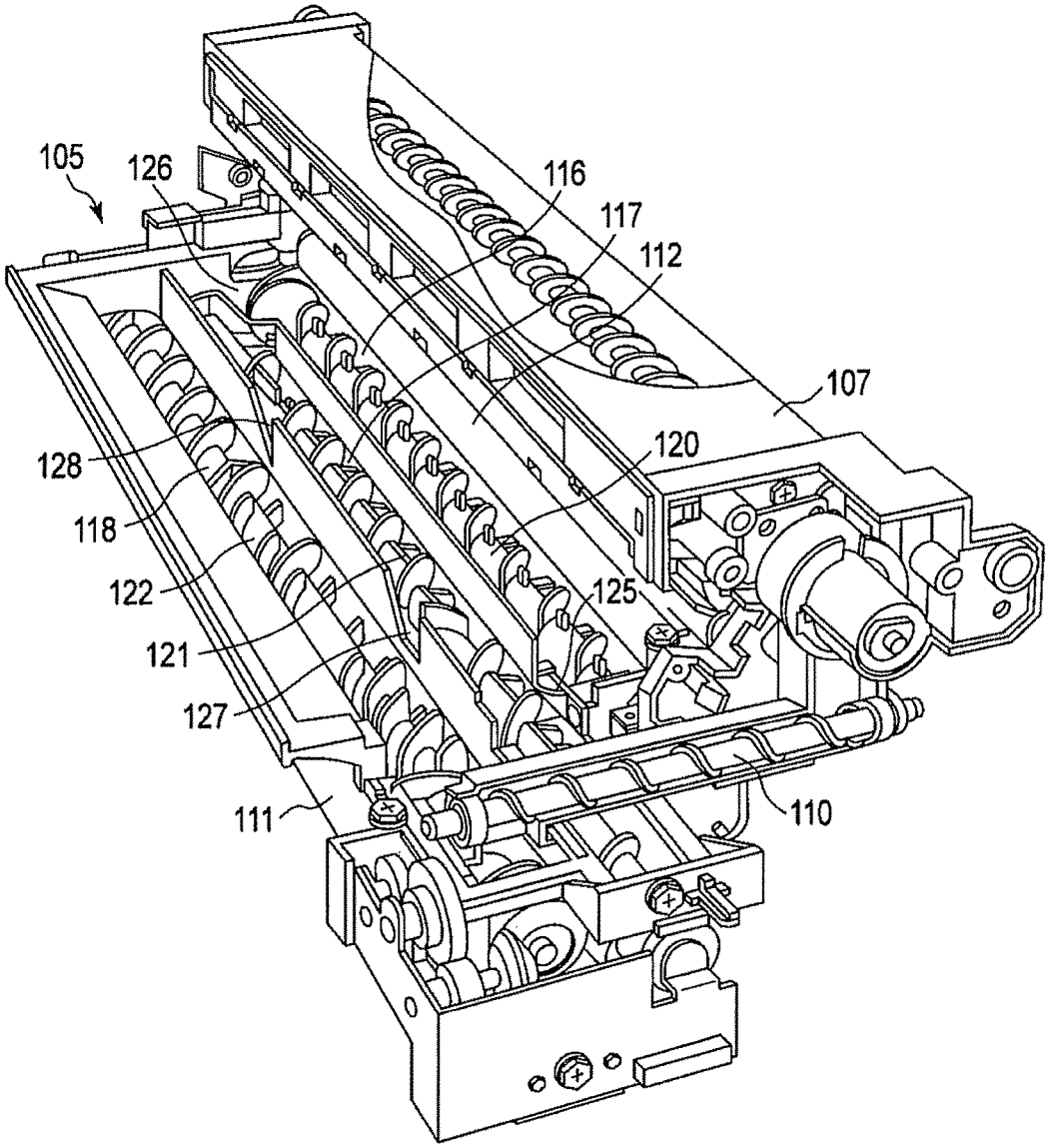
FIG. 2 is a perspective view showing an internal structure of a developing device.

On the upper part of the developing device 105, a toner replenishing device 108 as a replenishing unit is provided. In the developing device 105, the developer of this embodiment is placed, and this developing device 105 is connected to the cleaning device 107 through a recovery mechanism 110 as a recovery unit as shown in FIG. 2.

In the recovery mechanism 110, an auger is used for conveying the toner. As the cleaning device 107, a currently available cleaning blade, cleaning brush, or the like is used.

On an upper surface of the copying machine main body 101, an original document placing stand 135 is provided, and on a lower side of this original document placing stand 135, a scanner 136 which exposes an original document on the original document placing stand 135 to a light is provided. The scanner 136 includes a light source 137 which irradiates the original document with a light, a first reflection mirror 138 which reflects a light reflected from the original document in a predetermined direction, second and third reflection mirrors 139 and 140 which sequentially reflect a light reflected from the first reflection mirror 138, and a light receiving element 141 which receives a light reflected from the third reflection mirror 140.

On the lower side in the copying machine main body 101, multi-stage paper feed cassettes 142 and 143 are provided, and from these paper feed cassettes 142 and 143, a paper is sent out. This paper is conveyed upward through a conveying system 144. In the conveying system 144, a conveying roller pair 145, a resist roller pair 146, an image transfer section, a fixing roller pair 147, and a discharge roller pair 148 are arranged.

When an image is formed, a light is irradiated from the light source 137 onto an original document on the original document placing stand 135. This light is reflected from the original document and received by the light receiving element 141 through the first to third reflection mirrors 138 to 140, and the original document image is read. Based on this read information, a laser light LB is irradiated from a laser unit 104 onto the surface of the photoconductive drum 102. The surface of the photoconductive drum. 102 is negatively charged by the electrifying charger 103 and irradiated with the laser light LB from the laser unit 104, whereby the photoconductive drum 102 is exposed to the light. By doing this, in a region corresponding to an image portion of the original document, the surface potential of the photoconductive drum 102 comes closer to 0 depending on the image density, whereby an electrostatic latent image is formed. This electrostatic latent image is made to face the developing device 105 by the rotation of the photoconductive drum 102, and converted into a visible image by adsorbing the toner supplied through the carrier at this position.

At this time, a paper is supplied and conveyed from the paper feed cassette 142 or 143, and aligned by the resist roller 146. Thereafter, the paper is sent to the image transfer section between the transferring charger 106 and the photoconductive drum 102, and a visible image on the photoconductive drum 102 is transferred onto the paper.

The paper having the image transferred thereon is conveyed to the fixing roller pair 147. The paper is pressurized and also heated there, whereby the image is fixed to the paper. The developer containing the toner of this embodiment has excellent low-temperature fixability, and fixation can be achieved at, for example, about 140° C. or lower. After the fixation, the paper is discharged onto a Paper discharge tray 150 through the paper discharge roller pair 148.

On the other hand, the toner which is not transferred onto the paper in the image transfer section described above and remains on the surface of the photoconductive drum 102 is removed by the cleaning device 107, and then returned to the developing device 105 by the recovery mechanism 110 and reused. Further, when the toner in the developing device 105 is consumed by the development described above, the toner is replenished from the toner replenishing device 108.

Next, the above-described developing device 105 will be described with reference to FIGS. 2 and 3.

In one or more embodiments, a toner container (e.g., developing device 105) can be configured to store the toner described herein. For example, the developing device 105 includes a developing vessel 111, and in the developing vessel 111, a developing roller 112 is rotatably provided. The developing roller 112 is made to face the lower surface of the photoconductive drum 102 and supplies the developer to the photoconductive drum 102 by rotation.

The interior of the developing vessel 111 is partitioned into a first chamber 116, a second chamber 117, and a third chamber 118 substantially parallel along the axial direction of the photoconductive drum 102 with partition walls 114 and 115 as first and second partition members. In the first chamber 116, a first mixer 120 is provided as a first stirring and conveying member, in the second chamber 117, a second mixer 121 is provided as a second stirring and conveying member, and in the third chamber 118, a third mixer 122 is provided as a third stirring and conveying member.

The first mixer 120 stirs and conveys the developer from one end side thereof to a first direction (indicated by the arrow in FIG. 3) toward the other end side thereof by rotation to supply the developer to the developing roller 112. The second and third mixers 121 and 122 stir and convey the developer in a second direction (indicated by the arrow in FIG. 3) opposite to the first direction to send the developer to one end side of the first mixer 120.

The second and third mixers 121 and 122 are rotationally driven by a driving unit. That is, the driving unit includes a driving motor 162 as a single driving source and a driving gear 163 which is rotated by this driving motor 162. To the driving gear 163, a rotary shaft 151 (described below) of the third mixer 122 is connected through a power transmission gear 164 with a large diameter. Further, to the power transmission gear 164 with a large diameter, a rotary shaft 121*a* of the second mixer 121 is connected through a power transmission gear 165 with a small diameter.

According to this configuration, the conveying speed of the developer by the third mixer 122 is decreased to about ⅙ of the conveying speed of the developer by the second mixer 121, and the stirring and conveying time of the developer by the third mixer 122 is set to be longer than the stirring and conveying time of the developer by the second mixer 121.

Incidentally, the second and third mixers 121 and 122 may be independently rotationally driven by multiple driving motors so that the rotation speeds are made different.

Further, by providing a backward blade for conveying the recovered toner in the direction opposite to the second direction for the third mixer 122, the conveying speed of the recovered toner may be made slower than the conveying speed of the developer by the second mixer 121.

Next, a developing operation of the developing device 105 will be described.

Figure 3:
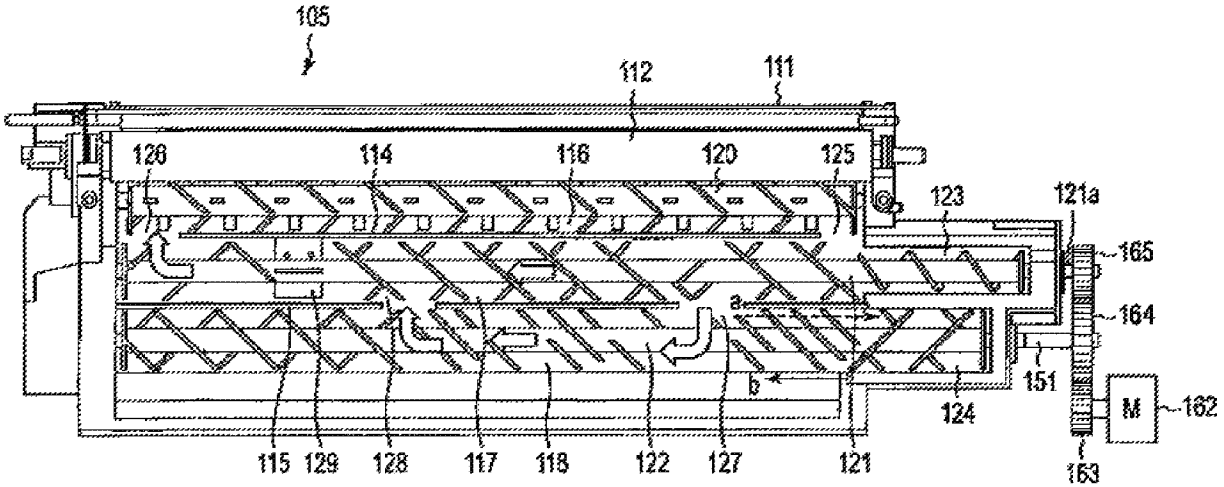
FIG. 3 is a plan view showing the internal structure of the developing device.

As shown in FIG. 3, by the rotation of the first mixer 120, the developer is stirred and conveyed in the first direction, that is, from one end of the first mixer 120 to the other end thereof as indicated by the arrow to supply the developer to the developing roller 112. This developer is supplied to the electrostatic latent image on the photoconductive drum 102 by the rotation of the developing roller 112, whereby the electrostatic latent image is visualized.

Further, the developer conveyed from the first mixer 120 is guided in the second chamber 117 through a first communication section 125 of the first partition wall 114, and this developer is conveyed in the arrow direction (second direction) by the rotation of the second mixer 121. The developer conveyed from the second mixer 121 is sent to one end side of the first mixer 120 through a fourth communication section 126 and conveyed to the first mixer 120 in a circulatory manner.

Further, a portion of the developer conveyed by the second mixer 121 is sent in the third chamber 118 from a second communication section 127 of the second partition wall 115 and conveyed in the arrow direction (second direction). This developer is sent in the second chamber 117 again from a third communication section 128 of the second partition wall 115, and stirred and conveyed by the second mixer 121 and sent to one end side of the first mixer 120 through the fourth communication section 126.

On the other hand, with respect to the developer to be stirred and conveyed by the second mixer 121 described above, the toner density thereof is detected by a toner density detector 129. When the toner density detected by this toner density detector 129 is decreased to a predetermined value or less, the toner is replenished from the toner replenishing device 108. This toner is dropped in a fresh toner receiving section 123 of the developing vessel 111. This fresh toner is stirred and conveyed in the arrow direction (second direction) by the rotation of the second mixer 121, and sent to one end side of the first mixer 120 in the same manner as described above.

Further, the toner recovered from the cleaning device 107 by the recovery mechanism 110 is dropped in a recycled toner receiving section 124. This recycled toner is conveyed in the arrow direction (second direction) by the rotation of the third mixer 122. At this time, the developer sent in the third chamber 118 from the second communication section 127 is once stirred and conveyed in the opposite direction as indicated by the arrow (a), that is, toward the recycled toner receiving section 124 by the rotation of the backward blade 153 of the third mixer 122, and then, stirred and conveyed in the forward direction as indicated by the arrow (b), that is, in the second direction by the rotation of a forward blade 152. This developer is sent to one end side of the first mixer 120 through the third communication section 128 in the same manner as described above.

Incidentally, the developer sent downstream in the conveying direction without being sent in the second chamber 117 through the third communication section 128 is sent backward and returned to the third communication section 128 by the rotation of the backward blade 153 and sent to the second chamber 117 through this third communication section 128.

When the toner is recycled as described above, the inorganic oxide particles fall off from the toner particles due to stress, and therefore, the fluidity of the toner may be deteriorated. In the toner of this embodiment, hydrophobic silica having a small particle diameter such that the average primary particle diameter is from 8 to 35 nm is externally added to the toner particles, and this hydrophobic silica is hardly released from the toner particles. Since the fluidity of the toner is ensured, favorable development can be achieved.

Figure 4:
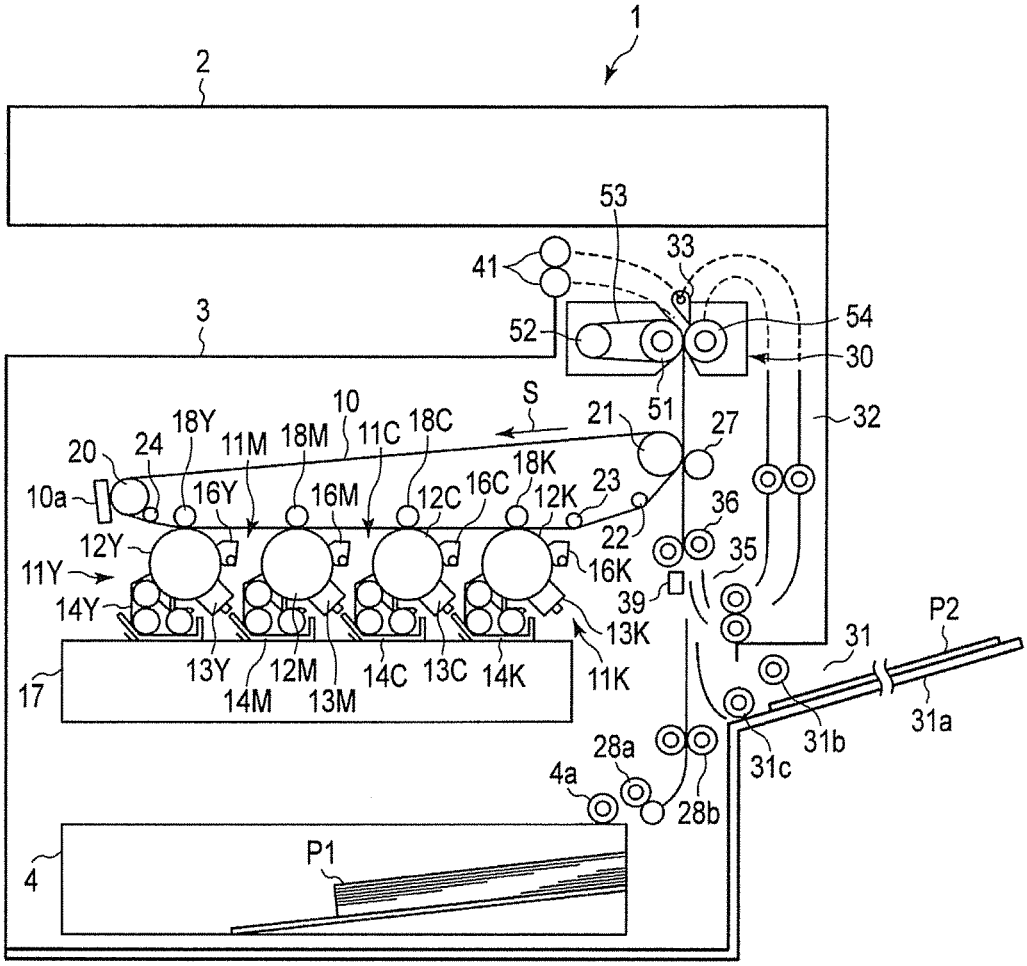
FIG. 4 is an internal structural view showing another example of an image forming apparatus.

The developer containing the toner according to the embodiment can be applied also to an image forming apparatus shown in FIG. 4. An image forming apparatus 1 shown in FIG. 4 is a color copying machine NFP (e-studio 4520c) of a four-series tandem system and includes a scanner section 2 in an upper part and also includes a paper discharge section 3.

The color copying machine 1 includes image forming stations 11Y, 11M, 11C, and 11K for the following four colors: yellow (Y), magenta (M), cyan (C), and black (K), which are arranged in parallel along the lower side of an intermediate transfer belt (intermediate transfer medium) 10.

The image forming stations 11Y, 11M, 11C, and 11K include photoconductive drums (image carrying bodies) 12Y, 12M, 12C, and 12K, respectively. Around the photoconductive drums 12Y, 12M, 12C, and 12K, electrifying chargers 13Y, 13M, 13C, and 13K, developing devices 14Y, 14M, 14C, and 14K, and photoconductor cleaning devices 16Y, 16M, 16C, and 16K are arranged along the rotating direction of the photoconductive drums, respectively. An area between each of the electrifying chargers 13Y, 13M, 13C, and 13K and each of the developing devices 14Y, 14M, 14C, and 14K around each of the photoconductive drums 12Y, 12M, 120, and 12K is irradiated with an exposure light from a laser exposing device (latent image forming device) 17 to form an electrostatic latent image on each of the photoconductive drums 12Y, 12M, 12C, and 12K.

The developing devices 14Y, 14M, 14C, and 14K each contain a two-component developer composed of a carrier and each of the toners of the respective colors of yellow (Y), magenta (M), cyan (C), and black (K) and supply the toner to the electrostatic latent images on the photoconductive drums 12Y, 12M, 12C, and 12K, respectively.

The intermediate transfer belt 10 is tensioned by a backup roller 21, a driven roller 20, and first to third tension rollers 22 to 24. The intermediate transfer belt 10 faces and is in contact with the photoconductive drums 12Y, 12M, 12C, and 12K. Primary transfer rollers 18Y, 18M, 18C, and 18K for primarily transferring a toner image on each of the photoconductive drums 12Y, 12M, 12C, and 12K onto the intermediate transfer belt 10 are provided at positions where the intermediate transfer belt 10 faces the photoconductive drums 12Y, 12M, 12C, and 12K, respectively. These primary transfer rollers 18Y, 18M, 18C, and 18K are each a conductive roller, and a primary transfer bias voltage is applied to each of these primary transfer sections.

A secondary transfer roller 27 is disposed in a secondary transfer section which is a transfer position where the intermediate transfer belt 10 is supported by the backup roller 21. In the secondary transfer section, the backup roller 21 is a conductive roller, and a predetermined secondary transfer bias is applied. When a sheet paper (final transfer medium) to be printed passes between the intermediate transfer belt 10 and the secondary transfer roller 27, the toner image on the intermediate transfer belt 10 is secondarily transferred onto the sheet paper. After the secondary transfer is completed, the intermediate transfer belt 10 is cleaned by a belt cleaner 10*a*.

A paper feed cassette 4 for supplying a sheet paper P1 in the direction of the secondary transfer roller 27 is provided below the laser exposing device 17. A manual feed mechanism 31 for manually feeding a sheet paper P2 is provided on the right side of the color copying machine 1.

A pickup roller 4*a*, a separation roller 28*a*, a conveying roller 28*b*, and a resist roller pair 36 are provided between the paper feed cassette 4 and the secondary transfer roller 27, and a paper feed mechanism is constituted by these members. Further, a manual pickup roller 31*b* and a manual separation roller 31*c* are provided between a manual feed tray 31*a* of the manual feed mechanism 31 and the resist roller pair 36.

Further, a media sensor 39 for detecting the type of sheet paper is disposed on a vertical conveying path 35 for conveying the sheet paper in the direction of the secondary transfer roller 27 from the paper feed cassette 4 or the manual feed tray 31*a*. The color copying machine 1 is configured such that the conveying speed of the sheet paper, the transfer conditions, the fixing conditions, and the like can be controlled based on the detection result by the media sensor 39. Further, a fixing device 30 is provided downstream of the secondary transfer section along the direction of the vertical conveying path 35.

The sheet paper taken out from the paper feed cassette 4 or fed from the manual feed mechanism 31 is conveyed to the fixing device 30 through the resist roller pair 36 and the secondary transfer roller 27 along the vertical conveying path 35. The fixing device 30 includes a fixing belt 53 wound around a set of a heating roller 51 and a driving roller 52, and a counter roller 54 disposed to face the heating roller 51 through the fixing belt 53. The sheet paper having the toner image transferred thereon in the secondary transfer section is introduced between the fixing belt 53 and the counter roller 54, and is heated by the heating roller 51, whereby the toner image transferred onto the sheet paper is fixed by a heat treatment. The developer of this embodiment has excellent low-temperature fixability and can be fixed at, for example, about 125° C. or lower.

A gate 33 is provided downstream of the fixing device 30, and the sheet paper is distributed in the direction of a paper discharge roller 41 or in the direction of a reconveying unit 32. The sheet paper guided to the paper discharge roller 41 is discharged to a paper discharge section 3. Further, the sheet paper guided to the reconveying unit 32 is guided again in the direction of the secondary transfer roller 27.

The image forming station 11Y integrally includes the photoconductive drum 12Y and a process unit and is provided detachably with respect to an image forming apparatus main body. The process unit refers to at least one of the electrifying charger 13Y, the developing device 14Y, and the photoconductor cleaning device 16Y. Also the image forming stations 11M, 11C, and 11K have the same structure as that of the image forming station 11Y. The image forming stations 11Y, 11M, 11C, and 11K may be provided independently detachably with respect to the image forming apparatus, or may be provided detachably with respect to the image forming apparatus as an integrated image forming unit 11.

The color copying machine as described above is a high-speed machine, and stress applied to the toner is relatively large. Therefore, the inorganic oxide particles may fall off from the toner particles so as to deteriorate the fluidity of the toner. In the toner of this embodiment, hydrophobic silica having a small particle diameter such that the average primary particle diameter is from 8 to 35 nm is externally added to the toner particles, and this hydrophobic silica is hardly released from the toner particles. Since the fluidity of the toner is ensured, favorable development can be achieved.

Incidentally, the reason why fixation is achieved at 125° C. or lower in a color machine while fixation is achieved at 140° C. or lower in a monochrome machine is due to the structure of a fixing device. In general, in a color machine, a fixing belt system is adopted and a nip width is set wide in order to obtain a superimposed image. Therefore, a color machine is known to be advantageous to low-temperature fixation. On the other hand, in a monochrome machine, from the viewpoint that a superimposed image is not obtained or the cost is reduced, a fixing roller system is often adopted, and in this case, a nip width is decreased when the same pressure is applied. Due to this, the fixing temperature in a monochrome machine is set higher than the target fixing temperature in a color machine. However, as compared with a conventional toner, the target fixing temperature can be decreased by about 10° C. even in a monochrome machine.

Hereinafter, embodiments will be more specifically described with reference to Examples.

Preparation Example of Ester Wax

In a four-necked flask equipped with a stirrer, a thermocouple, and a nitrogen introducing pipe, 80 parts by weight of a long-chain alkyl carboxylic acid component and 20 parts by weight of a long-chain alkyl alcohol component were placed and subjected to an esterification reaction at 220° C. in a nitrogen gas stream. The obtained reaction product was diluted with a mixed solvent of toluene and ethanol, and then, a sodium hydroxide aqueous solution was added thereto, and the mixture was stirred at 70° C. for 30 minutes. Thereafter, the reaction mixture was left to stand for 30 minutes, and then, the aqueous layer was removed. Further, an operation in which ion exchanged water is added, the mixture is stirred at 70° C. for 30 minutes, and then, the reaction mixture is left to stand for 30 minutes, followed by removing the aqueous layer was repeated five times. The solvent was distilled off from the thus obtained ester layer under a reduced pressure condition, whereby an ester wax A having an acid value of 0.1 mg KOH/g and a hydroxyl value of 0.5 mg KOH/g was obtained. The structural formula of the ester wax is represented by the following formula (1).

$$CH_3(CH_2)_nCOO(CH_2)_mCH_3 \quad (1)$$

(In the formula (1), n and m each represent a constant.)

Each ester wax was prepared by changing the type and the amount of each of the long-chain alkyl carboxylic acid and the long-chain alkyl alcohol. In particular, when the distribution of carbon numbers is expanded, the preparation was carried out by using multiple types of long-chain alkyl carboxylic acid components and multiple types of long-chain alkyl alcohol components.

The data of each ester wax is shown in Table 1.

TABLE 1

| | Content of ester compound (%) | | | | | | | | | | | | Melting | Acid value | Hydroxyl value |
|---|---|---|---|---|---|---|---|---|---|---|---|---|---|---|---|
| Wax | C32 | C34 | C36 | C38 | C40 | C42 | C44 | C46 | C48 | C50 | C52 | C54 | point (° C.) | (mg KOH/g) | (mg KOH/g) |
| A | 0 | 0 | 2.9 | 6.8 | 10.7 | 21 | 40.6 | 5.4 | 2.6 | 5.6 | 4.4 | 0 | 68 | 0.1 | 0.5 |
| B | 0 | 0 | 0.1 | 3.6 | 12.4 | 25.1 | 55 | 2.6 | 1.1 | 0.1 | 0 | 0 | 75 | 0.1 | 0.4 |
| C | 0 | 0 | 6.1 | 2.5 | 0.9 | 17.1 | 14.1 | 50 | 4.5 | 4.8 | 0 | 0 | 73 | 0.1 | 0.4 |
| D | 0 | 0 | 3.7 | 6.1 | 24.4 | 12 | 8 | 25.6 | 2.4 | 2.7 | 12.3 | 2.8 | 63 | 0.1 | 0.4 |
| E | 0 | 0 | 5.8 | 4 | 11.1 | 21.6 | 1.9 | 2.4 | 20.9 | 19.8 | 12.4 | 0.1 | 63 | 0.1 | 0.5 |
| F | 0 | 0 | 4.5 | 5.3 | 13.1 | 25.5 | 2.4 | 2.6 | 20.1 | 19.8 | 6.7 | 0 | 63 | 0.1 | 0.4 |
| G | 0 | 0 | 0.1 | 8.7 | 25.6 | 55 | 7.5 | 2.3 | 0.6 | 0.2 | 0 | 0 | 61 | 0.1 | 0.4 |

Long-Chain Alkyl Carboxylic Acid Component palmitic acid ($C_{16}H_{32}O_2$)
stearic acid ($C_{18}H_{36}O_2$)
arachidonic acid ($C_{20}H_{40}O_2$)
behenic acid ($C_{22}H_{44}O_2$)
lignoceric acid ($C_{24}H_{48}O_2$)
cerotic acid ($C_{26}H_{52}O_2$)
montanoic acid ($C_{28}H_{56}O_2$)

Long-Chain Alkyl Alcohol Component palmityl alcohol ($C_{16}H_{34}O$)
stearyl alcohol ($C_{18}H_{38}O$)
arachidyl alcohol ($C_{20}H_{42}O$)
behenyl alcohol ($C_{22}H_{46}O$)
lignoceryl alcohol ($C_{24}H_{50}O$)
ceryl alcohol ($C_{26}H_{54}O$)
montanyl alcohol ($C_{28}H_{58}O$)

In the measurement of the melting point of the obtained ester wax, a differential scanning calorimeter (DSC) "DSC 02000" (manufactured by TA INSTRUMENTS, Inc.) is used. The measurement is carried out under the following conditions: sample: 5 mg, lid and pan: alumina, temperature raising rate: 10° C./min, and measurement temperature: 20 to 200° C. The sample heated to 200° C. is cooled to 20° C. or lower. Then, the sample is heated again, and the measurement is carried out, and the thus obtained data is used. A maximum endothermic peak occurring at a temperature in the range from around 60° C. to around 80° C. is defined as the melting point of the wax.

Further, a maximum endothermic peak occurring at a temperature in the range from around 80° C. to around 120° C. is defined as the melting point of the crystalline polyester resin.

In a mass analysis of the obtained ester wax, FD/MS (JMS-T100GC, manufactured by JEOL Ltd.) is used. The measurement is carried out under the following conditions: sample: 1 mg (dissolved in 1 mL of chloroform), cathode voltage: −10 kV, spectrum recording interval: 0.4 seconds, and measuring mass range: m/z 10 to 2000. The intensities for the respective carbon numbers of the ester compounds were summed and the sum was taken as 100%, and a relative intensity for each carbon number was calculated, and the maximum intensity was confirmed.

Incidentally, with respect to an ester wax (P) in which rice wax was used, C54 was determined to show the maximum intensity.

The acid value and the hydroxyl value of each of the obtained ester waxes were measured according to JIS K0070.

Preparation of Comparative Ester Wax (H)

By increasing the blending amounts of behenic acid and behenyl alcohol, a comparative ester wax (H) in which the ester compound having a carbon number showing the maximum frequency among the carbon numbers of C32 to C54 accounts for 60% or more of the entire wax was prepared. The data of the comparative ester wax (H) is shown in Table 2.

Preparation of Comparative Ester Wax (I)

By increasing the blending amounts of stearic acid, arachidic acid, stearyl alcohol, and arachidyl alcohol, a comparative ester wax (I) in which the ester compounds having a carbon number of 38 or less account for 10% or more of the entire wax was prepared. The data of the comparative ester wax (I) is shown in Table 2.

Preparation of Comparative Ester Wax (J)

By increasing the blending amounts of stearic acid, arachidic acid, stearyl alcohol, and arachidyl alcohol, a comparative ester wax (J) in which the ester compound having a carbon number of 44 accounts for less than 20% of the entire wax was prepared. The data of the comparative ester wax (J) is shown in Table 2.

Preparation of Comparative Ester Wax (K)

By using only palmitic acid as the acid component and using only palmityl alcohol as the alcohol component, a comparative ester wax (K) was prepared. The data of the comparative ester wax (K) is shown in Table 2.

Preparation of Comparative Ester Wax (L)

By increasing the blending amounts of behenic acid and behenyl alcohol, a comparative ester wax (L) in which the ester compound having a carbon number showing the maximum frequency among the carbon numbers of C32 to C54 accounts for 20 to 55% of the entire wax, however, the ratio (d/a) of the distribution of carbon numbers smaller than the carbon number showing the maximum frequency is less than 0.619, and the ratio (g/a) of the distribution of carbon numbers larger than the carbon number showing the maximum frequency is more than 0.2 was prepared. The data of the comparative ester wax (L) is shown in Table 2.

Preparation of Comparative Ester Wax (M)

By using only behenic acid as the acid component and using only behenyl alcohol as the alcohol component, a comparative ester wax (M) was prepared. The data of the comparative ester wax (M) is shown in Table 2.

Preparation of Comparative Ester Wax (N)

By increasing the blending amounts of lignoceric acid and lignoceryl alcohol, a comparative ester wax (N) in which the ester compound having a carbon number showing the maximum frequency among the carbon numbers of C32 to C54 accounts for less than 20% of the entire wax, and the distribution of carbon numbers is broad was prepared. The data of the comparative ester wax (N) is shown in Table 2.

Preparation of Comparative Ester Wax (O)

By decreasing the blending amounts of stearic acid and stearyl alcohol, a comparative ester wax (O) in which the ester compound having a carbon number showing the maximum frequency among the carbon numbers of C32 to C54 accounts for 20% or more and 55% or less of the entire wax, and the distribution of carbon numbers is broad was prepared. The data of the comparative ester wax (O) is shown in Table 0.2.

Comparative Ester Wax (P)

Rice wax is used. The data is shown in Table 3.

TABLE 2

| | Content of ester compound (%) | | | | | | | | | | | | Melting | Acid value | Hydroxyl value |
|---|---|---|---|---|---|---|---|---|---|---|---|---|---|---|---|
| Wax | C32 | C34 | C36 | C38 | C40 | C42 | C44 | C46 | C48 | C50 | C52 | C54 | point (° C.) | (mg KOH/g) | (mg KOH/g) |
| H | 0 | 0 | 0 | 0.5 | 9.8 | 17.8 | 68 | 2.4 | 1.5 | 0 | 0 | 0 | 77 | 0.1 | 0.5 |
| I | 0 | 0 | 5.3 | 6.8 | 13.8 | 27 | 40 | 2.7 | 4.4 | 0 | 0 | 0 | 65 | 0.1 | 0.5 |
| J | 0 | 5.4 | 14.7 | 13.9 | 18.7 | 9.5 | 17.8 | 13.6 | 6.4 | 0 | 0 | 0 | 63 | 0.1 | 0.3 |
| K | 100 | 0 | 0 | 0 | 0 | 0 | 0 | 0 | 0 | 0 | 0 | 0 | 59 | 0.1 | 0.4 |
| L | 0 | 0 | 0 | 0.5 | 5.6 | 15.6 | 53 | 14.5 | 10.4 | 0.4 | 0 | 0 | 69 | 0.1 | 0.4 |
| M | 0 | 0 | 0 | 0 | 0 | 0 | 100 | 0 | 0 | 0 | 0 | 0 | 75 | 0.1 | 0.2 |
| N | 0 | 0 | 0 | 6.8 | 17.6 | 18.4 | 19.6 | 18.6 | 15.4 | 3.6 | 0 | 0 | 63 | 0.1 | 0.3 |
| O | 0 | 0 | 0 | 5.9 | 12.1 | 23.5 | 45 | 6.8 | 4.3 | 2.4 | 0 | 0 | 67 | 0.1 | 0.5 |

TABLE 3

| | Content of ester compound (%) | | | | | | | | | | | | Melting | Acid value | Hydroxyl value |
|---|---|---|---|---|---|---|---|---|---|---|---|---|---|---|---|
| Wax | C46 | C48 | C50 | C52 | C54 | C56 | C58 | C60 | C62 | C64 | C66 | C68 | point (° C.) | (mg KOH/g) | (mg KOH/g) |
| P | 7 | 12 | 13 | 18 | 20 | 15 | 10 | 5 | 0 | 0 | 0 | 0 | 79 | 6.3 | 15.4 |

Example 1

Polyester resin (binder): 63 parts by weight

Crystalline polyester resin: 20 parts by weight

Ester wax (A): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.4° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 1 was obtained.

Further, according to the formulations as shown below, developers of Examples 2 to 26 and developers of Comparative Examples 1 to 18 were obtained.

Example 2

Polyester resin (binder): 85 parts by weight

Crystalline polyester resin: 3 parts by weight

Ester wax (A): 5 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 43.4° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 2 was obtained.

Example 3

Polyester resin (binder): 63 parts by weight
Crystalline polyester resin: 20 parts by weight
Ester wax (A): 10 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.9° C. was obtained.

With respect to 100 parts by weight of this powder, the following additives were added and mixed in a Henschel mixer, whereby a toner was produced.

Hydrophobic silica having an average primary particle diameter of 35 nm: 0.8 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 3 was obtained.

Example 4

Polyester resin (binder): 63 parts by weight
Crystalline polyester resin: 20 parts by weight
Ester wax (A): 10 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.5° C. was obtained.

With respect to 100 parts by weight of this powder, the following additives were added and mixed in a Henschel mixer, whereby a toner was produced.

Hydrophobic silica having an average primary particle diameter of 35 nm: 0.2 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 4 was obtained.

Example 5

Polyester resin (binder): 85 parts by weight
Crystalline polyester resin: 5 parts by weight
Ester wax (A): 3 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.9° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 5 was obtained.

Example 6

Polyester resin (binder): 63 parts by weight
Crystalline polyester resin: 20 parts by weight
Ester wax (A): 10 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.4° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 6 was obtained.

Example 7

Polyester resin (binder): 83 parts by weight
Crystalline polyester resin: 5 parts by weight
Ester wax (B): 5 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 43.2° C. was obtained.

With respect to 100 parts by weight of this powder, the following additives were added and mixed in a Henschel mixer, whereby a toner was produced.

Hydrophobic silica having an average primary particle diameter of 30 nm: 0.3 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 7 was obtained.

Example 8

Polyester resin (binder): 85 parts by weight

Crystalline polyester resin: 3 parts by weight

Ester wax (B): 5 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 43.6° C. was obtained.

With respect to 100 parts by weight of this powder, the following additives were added and mixed in a Henschel mixer, whereby a toner was produced.

Hydrophobic silica having an average primary particle diameter of 30 nm: 0.3 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 8 was obtained.

Example 9

Polyester resin (binder): 63 parts by weight

Crystalline polyester resin: 20 parts by weight

Ester wax (B): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 34.8° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 9 was obtained.

Example 10

Polyester resin (binder): 63 parts by weight

Crystalline polyester resin: 20 parts by weight

Ester wax (B): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 34.6° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 10 was obtained.

Example 11

Polyester resin (binder): 87 parts by weight

Crystalline polyester resin: 3 parts by weight

Ester wax (C): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 45.0° C. was obtained.

With respect to 100 parts by weight of this powder, the following additives were added and mixed in a Henschel mixer, whereby a toner was produced.

Hydrophobic silica having an average primary particle diameter of 10 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 11 was obtained.

Example 12

Polyester resin (binder): 87 parts by weight

Crystalline polyester resin: 3 parts by weight

Ester wax (C): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 45.0° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 12 was obtained.

Example 13

Polyester resin (binder): 87 parts by weight

Crystalline polyester resin: 3 parts by weight

Ester wax (C): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.8° C. was obtained.

With respect to 100 parts by weight of this powder, the following additives were added and mixed in a Henschel mixer, whereby a toner was produced.

Hydrophobic silica having an average primary particle diameter of 35 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 13 was obtained.

Example 14

Polyester resin (binder): 87 parts by weight

Crystalline polyester resin: 3 parts by weight

Ester wax (C): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.7° C. was obtained.

With respect to 100 parts by weight of this powder, the following additives were added and mixed in a Henschel mixer, whereby a toner was produced.

Hydrophobic silica having an average primary particle diameter of 10 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 14 was obtained.

Example 15

Polyester resin (binder): 63 parts by weight

Crystalline polyester resin: 20 parts by weight

Ester wax (D): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.2° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 15 was obtained.

Example 16

Polyester resin (binder): 63 parts by weight
Crystalline polyester resin: 20 parts by weight
Ester wax (D): 10 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.5° C. was obtained.

With respect to 100 parts by weight of this powder, the following additives were added and mixed in a Henschel mixer, whereby a toner was produced.

Hydrophobic silica having an average primary particle diameter of 8 nm: 0.2 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 16 was obtained.

Example 17

Polyester resin (binder): 85 parts by weight
Crystalline polyester resin: 5 parts by weight
Ester wax (D): 3 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.7° C. was obtained.

With respect to 100 parts by weight of this powder, the following additives were added and mixed in a Henschel mixer, whereby a toner was produced.

Hydrophobic silica having an average primary particle diameter of 8 nm: 0.3 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 17 was obtained.

Example 18

Polyester resin (binder): 73 parts by weight
Crystalline polyester resin: 10 parts by weight
Ester wax (E): 10 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 36.7° C. was obtained.

With respect to 100 parts by weight of this powder, the following additives were added and mixed in a Henschel mixer, whereby a toner was produced.

Hydrophobic silica having an average primary particle diameter of 10 nm: 0.3 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 18 was obtained.

Example 19

Polyester resin (binder): 61 parts by weight
Crystalline polyester resin: 20 parts by weight
Ester wax (E): 12 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.6° C. was obtained.

With respect to 100 parts by weight of this powder, the following additives were added and mixed in a Henschel mixer, whereby a toner was produced.

Hydrophobic silica having an average primary particle diameter of 35 nm: 0.3 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 19 was obtained.

Example 20

Polyester resin (binder): 83 parts by weight
Crystalline polyester resin: 5 parts by weight
Ester wax (E): 5 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 43.2° C. was obtained.

With respect to 100 parts by weight of this powder, the following additives were added and mixed in a Henschel mixer, whereby a toner was produced.

Hydrophobic silica having an average primary particle diameter of 35 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 20 was obtained.

Example 21

Polyester resin (binder): 73 parts by weight

Crystalline polyester resin: 10 parts by weight

Ester wax (F): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 36.7° C. was obtained.

With respect to 100 parts by weight of this powder, the following additives were added and mixed in a Henschel mixer, whereby a toner was produced.

Hydrophobic silica having an average primary particle diameter of 10 nm: 0.3 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 21 was obtained.

Example 22

Polyester resin (binder): 68 parts by weight

Crystalline polyester resin: 15 parts by weight

Ester wax (F): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 35.0° C. was obtained.

With respect to 100 parts by weight of this powder, the following additives were added and mixed in a Henschel mixer, whereby a toner was produced.

Hydrophobic silica having an average primary particle diameter of 35 nm: 0.3 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 22 was obtained.

Example 23

Polyester resin (binder): 83 parts by weight

Crystalline polyester resin: 5 parts by weight

Ester wax (F): 5 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 43.1° C. was obtained.

With respect to 100 parts by weight of this powder, the following additives were added and mixed in a Henschel mixer, whereby a toner was produced.

Hydrophobic silica having an average primary particle diameter of 35 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 23 was obtained.

Example 24

Polyester resin (binder): 87 parts by weight

Crystalline polyester resin: 3 parts by weight

Ester wax (G): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.5° C. was obtained.

With respect to 100 parts by weight of this powder, the following additives were added and mixed in a Henschel mixer, whereby a toner was produced.

Hydrophobic silica having an average primary particle diameter of 10 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 24 was obtained.

Example 25

Polyester resin (binder): 61 parts by weight

Crystalline polyester resin: 20 parts by weight

Ester wax (G): 12 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.6° C. was obtained.

With respect to 100 parts by weight of this powder, the following additives were added and mixed in a Henschel mixer, whereby a toner was produced.

Hydrophobic silica having an average primary particle diameter of 35 nm: 0.6 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 25 was obtained.

Example 26

Polyester resin (binder): 78 parts by weight

Crystalline polyester resin: 10 parts by weight

Ester wax (G): 5 parts by weight

Coloring agent (MA-100): 6 parts by weight

Charge control agent (a polysaccharide compound containing Al and Mg): 1 part by weight The above materials were mixed in a HENSCHEL MIXER, and the resulting mixture was melt-kneaded by a twin-screw extruder. The obtained melt-kneaded material was cooled and then coarsely pulverized by a hammer mill. Subsequently, the coarsely pulverized material was further pulverized using a pulverizer manufactured by HOSOKAWA MICRON CORPORATION, whereby moderately pulverized particles having a volume average particle diameter of 59 μm were obtained. 30 parts by weight of the obtained moderately pulverized particles, 1 part by weight of sodium dodecylbenzenesulfonate (Neopelex G-15) as an anionic surfactant, 1 part by weight of triethylamine as an amine compound, and 68 parts by weight of ion exchanged water were stirred in a homogenizer manufactured by IKA CORPORATION, whereby a mixed solution 1 was obtained.

Subsequently, the obtained mixed solution 1 was put into a NANOMIZER (YSNM-2000AR, manufactured by YOSHIDA KIKAI CO., LTD., to which a heating system was added) in which the temperature of the heating system was set to 120° C. and processed repeatedly three times at a processing pressure of 150 MPa. After cooling, the volume average particle diameter of the obtained colored fine particles was measured by SALD-7000 (manufactured by SHIMADZU CORPORATION) and found to be 0.7 μm. The pH of the fine particle dispersion liquid was 8.3.

Subsequently, the dispersion liquid was diluted such that the solid content concentration of the colored fine particles was 18%, and thereafter, the pH was adjusted by adding 0.1 M hydrochloric acid dropwise thereto. The temperature of the dispersion liquid was controlled to be 30° C. When the pH reached 7.0, the particle diameter was measured and found to be 0.84 μm. Further, 0.1 M hydrochloric acid was added dropwise thereto, and when the potential of the fine particles reached −30 mV, the dropwise addition was completed. At this time, the pH was 3.8.

Subsequently, the temperature of the above-described dispersion liquid was raised to 80° C. at a rate of 10° C./min while stirring the liquid with a paddle blade (at 500 rpm) and then kept at 80° C. for one hour. After cooling, the dispersion liquid was left to stand overnight, and the state of the supernatant was observed. As a result, the supernatant was transparent, and any unaggregated particle was not observed. Also, the volume average particle diameter of the precipitate was measured and found to be 6 μm, and any coarse particle with a volume average particle diameter of 20 μm or more was not observed. Thereafter, the precipitate was dried by a vacuum dryer until the water content was decreased to 0.8% by weight or less, whereby a powder having a volume average particle diameter of 6 μm and a toner Tg of 39.8° C. was obtained. With respect to 100 parts by weight of this powder, the following additives were added and mixed in a Henschel mixer, whereby a toner was produced.

Hydrophobic silica having an average primary particle diameter of 30 nm: 0.6 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Example 26 was obtained.

Comparative Example 1

Polyester resin (binder): 63 parts by weight

Crystalline polyester resin: 20 parts by weight

Ester wax (H): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 35.2° C. was obtained.

With respect to 100 parts by weight of this powder, the following additives were added and mixed in a Henschel mixer, whereby a toner was produced.

Hydrophobic silica having an average primary particle diameter of 35 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 1 was obtained.

Comparative Example 2

Polyester resin (binder): 85 parts by weight

Crystalline polyester resin: 3 parts by weight

Ester wax (H): 5 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.2° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 2 was obtained.

Comparative Example 3

Polyester resin (binder): 62 parts by weight

Crystalline polyester resin: 25 parts by weight

Ester wax (I): 6 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 30.1° C. was obtained.

With respect to 100 parts by weight of this powder, the following additives were added and mixed in a Henschel mixer, whereby a toner was produced.

Hydrophobic silica having an average primary particle diameter of 35 nm: 0.5 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 3 was obtained.

Comparative Example 4

Polyester resin (binder): 83 parts by weight

Ester wax (I): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 57.5° C. was obtained.

With respect to 100 parts by weight of this powder, the following additives were added and mixed in a Henschel mixer, whereby a toner was produced.

Hydrophobic silica having an average primary particle diameter of 8 nm: 0.5 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 4 was obtained.

Comparative Example 5

Polyester resin (binder): 73 parts by weight

Crystalline polyester resin: 10 parts by weight

Ester wax (J): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 36.4° C. was obtained.

With respect to 100 parts by weight of this powder, the following additives were added and mixed in a Henschel mixer, whereby a toner was produced.

Hydrophobic silica having an average primary particle diameter of 20 nm: 0.5 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 5 was obtained.

Comparative Example 6

Polyester resin (binder): 81 parts by weight
Crystalline polyester resin: 6 parts by weight
Ester wax (J): 6 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 42.1° C. was obtained.

With respect to 100 parts by weight of this powder, the following additives were added and mixed in a Henschel mixer, whereby a toner was produced.

Hydrophobic silica having an average primary particle diameter of 8 nm: 1.0 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 6 was obtained.

Comparative Example 7

Polyester resin (binder): 77 parts by weight
Crystalline polyester resin: 10 parts by weight
Ester wax (K): 6 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 36.1° C. was obtained.

With respect to 100 parts by weight of this powder, the following additives were added and mixed in a Henschel mixer, whereby a toner was produced.

Hydrophobic silica having an average primary particle diameter of 8 nm: 1.0 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 7 was obtained.

Comparative Example 8

Polyester resin (binder): 87 parts by weight
Ester wax (L): 6 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 55.6° C. was obtained.

With respect to 100 parts by weight of this powder, the following additives were added and mixed in a Henschel mixer, whereby a toner was produced.

Hydrophobic silica having an average primary particle diameter of 35 nm: 0.5 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 8 was obtained.

Comparative Example 9

Polyester resin (binder): 80 parts by weight
Crystalline polyester resin: 8 parts by weight
Ester wax (L): 5 parts by weight
Coloring agent (MA-100): 6 parts by weight
Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 44.7° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight
Hydrophobic silica having an average primary particle diameter of 100 nm: 0.8 parts by weight
Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 9 was obtained.

Comparative Example 10

Polyester resin (binder): 73 parts by weight
Crystalline polyester resin: 10 parts by weight Ester wax (L): 10 parts by weight Coloring agent (MA-100): 6 parts by weight Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 42.7° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 10 was obtained.

Comparative Example 11

Polyester resin (binder): 80 parts by weight

Crystalline polyester resin: 10 parts by weight

Ester wax (M): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 45.6° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 11 was obtained.

Comparative Example 12

Polyester resin (binder): 80 parts by weight

Crystalline polyester resin: 10 parts by weight

Ester wax (N): 3 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 40.6° C. was obtained.

With respect to 100 parts by weight of this powder, the following additives were added and mixed in a Henschel mixer, whereby a toner was produced.

Hydrophobic silica having an average primary particle diameter of 35 nm: 0.1 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 12 was obtained.

Comparative Example 13

Polyester resin (binder): 68 parts by weight

Crystalline polyester resin: 15 parts by weight

Ester wax (N): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 32.7° C. was obtained.

With respect to 100 parts by weight of this powder, the following additives were added and mixed in a Henschel mixer, whereby a toner was produced.

Hydrophobic silica having an average primary particle diameter of 8 nm: 1.0 parts by weight Hydrophobic silica having an average primary particle diameter of 100 nm: 0.8 parts by weight Hydrophobic titanium oxide having an average primary Particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 13 was obtained.

Comparative Example 14

Polyester resin (binder): 68 parts by weight

Crystalline polyester resin: 15 parts by weight

Ester wax (O): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 33.5° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 14 was obtained.

Comparative Example 15

Polyester resin (binder): 73 parts by weight

Crystalline polyester resin: 15 parts by weight

Ester wax (O): 5 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 38.7° C. was obtained.

With respect to 100 parts by weight of this powder, the following additives were added and mixed in a Henschel mixer, whereby a toner was produced.

Hydrophobic silica having an average primary particle diameter of 8 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 15 was obtained.

Comparative Example 16

Polyester resin (binder): 77 parts by weight

Crystalline polyester resin: 10 parts by weight

Ester wax (P): 6 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 45.6° C. was obtained.

With respect to 100 parts by weight of this powder, the following additives were added and mixed in a Henschel mixer, whereby a toner was produced.

Hydrophobic silica having an average primary particle diameter of 20 nm: 0.8 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 16 was obtained.

Comparative Example 17

Polyester resin (binder): 78 parts by weight

Ester wax (A): 15 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 54.6° C. was obtained.

With respect to 100 parts by weight of this powder, the following additives were added and mixed in a Henschel mixer, whereby a toner was produced.

Hydrophobic silica having an average primary particle diameter of 8 nm: 0.3 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 17 was obtained.

Comparative Example 18

Polyester resin (binder): 83 parts by weight

Ester wax (E): 10 parts by weight

Coloring agent (MA-100): 6 parts by weight

Charge control agent (a polysaccharide compound containing Al and Mg): 1 part by weight The above materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer, followed by classification, whereby a powder having a volume average particle diameter of 7 μm and a toner Tg of 56.5° C. was obtained.

With respect to 100 parts by weight of this powder, the following additives were added and mixed in a Henschel mixer, whereby a toner was produced.

Hydrophobic silica having an average primary particle diameter of 30 nm: 1.0 parts by weight Hydrophobic silica having an average primary particle diameter of 100 nm: 0.8 parts by weight Hydrophobic titanium oxide having an average primary particle diameter of 20 nm: 0.5 parts by weight The obtained toner was stirred in a tabular mixer in a proportion of 6 parts by weight with respect to 100 parts by weight of a silicone resin-surface coated ferrite carrier having an average particle diameter of 40 μm, whereby a developer of Comparative Example 18 was obtained.

With respect to the toners of Examples and Comparative Examples, the melting point and the addition amount of each of the ester wax and the crystalline polyester are summarized in the following Tables 4 and 5 together with the particle diameter and the addition amount of the hydrophobic silica having a smaller particle diameter. In the following tables, the addition amount is expressed as weight percent (wt %), and the particle diameter of the hydrophobic silica is the average primary particle diameter.

TABLE 4

| | | Ester wax | | Crystalline polyester | | Hydrophobic silica | |
|---|---|---|---|---|---|---|---|
| | Used wax | Melting point (° C.) | Addition amount (%) | Melting point (° C.) | Addition amount (%) | Particle diameter (nm) | Addition amount (%) |
| Example 1 | A | 68 | 10 | 85 | 20 | 8 | 0.2 |
| Example 2 | A | 68 | 5 | 90 | 3 | 8 | 0.8 |
| Example 3 | A | 68 | 10 | 110 | 20 | 35 | 0.8 |
| Example 4 | A | 68 | 10 | 105 | 20 | 35 | 0.2 |
| Example 5 | A | 68 | 3 | 110 | 5 | 8 | 0.2 |
| Example 6 | A | 68 | 10 | 85 | 20 | 8 | 0.8 |
| Example 7 | B | 75 | 5 | 85 | 5 | 30 | 0.3 |
| Example 8 | B | 75 | 5 | 90 | 3 | 30 | 0.3 |
| Example 9 | B | 75 | 10 | 90 | 20 | 8 | 0.2 |
| Example 10 | B | 75 | 10 | 85 | 20 | 8 | 0.2 |
| Example 11 | C | 73 | 3 | 90 | 3 | 10 | 0.2 |
| Example 12 | C | 73 | 3 | 110 | 3 | 8 | 0.2 |
| Example 13 | C | 73 | 3 | 105 | 3 | 35 | 0.2 |
| Example 14 | C | 73 | 3 | 85 | 3 | 10 | 0.8 |
| Example 15 | D | 63 | 10 | 85 | 20 | 8 | 0.2 |
| Example 16 | D | 63 | 10 | 90 | 20 | 8 | 0.2 |
| Example 17 | D | 63 | 3 | 110 | 5 | 8 | 0.3 |
| Example 18 | E | 63 | 10 | 85 | 10 | 10 | 0.3 |
| Example 19 | E | 63 | 12 | 90 | 20 | 35 | 0.3 |
| Example 20 | E | 63 | 5 | 85 | 5 | 35 | 0.8 |
| Example 21 | F | 63 | 10 | 90 | 10 | 10 | 0.3 |
| Example 22 | F | 63 | 10 | 105 | 15 | 35 | 0.3 |
| Example 23 | F | 63 | 5 | 85 | 5 | 35 | 0.8 |
| Example 24 | G | 61 | 3 | 85 | 3 | 10 | 0.8 |
| Example 25 | G | 61 | 12 | 90 | 20 | 35 | 0.6 |
| Example 26 | G | 61 | 5 | 110 | 10 | 30 | 0.6 |

TABLE 5

| | | Ester wax | | Crystalline polyester | | Hydrophobic silica | |
|---|---|---|---|---|---|---|---|
| | Used wax | Melting point (° C.) | Addition amount (%) | Melting point (° C.) | Addition amount (%) | Particle diameter (nm) | Addition amount (%) |
| Comparative Example 1 | H | 77 | 10 | 110 | 20 | 35 | 0.8 |
| Comparative Example 2 | H | 77 | 5 | 110 | 3 | 8 | 0.8 |
| Comparative Example 3 | I | 65 | 6 | 115 | 25 | 35 | 0.5 |
| Comparative Example 4 | I | 65 | 10 | Not added | 0 | 8 | 0.5 |
| Comparative Example 5 | J | 63 | 10 | 90 | 10 | 20 | 0.5 |
| Comparative Example 6 | J | 63 | 6 | 115 | 6 | 8 | 1 |
| Comparative Example 7 | K | 59 | 6 | 90 | 10 | 8 | 1 |
| Comparative Example 8 | L | 69 | 6 | Not added | 0 | 35 | 0.5 |
| Comparative Example 9 | L | 69 | 5 | 110 | 8 | 8 | 0.8 |
| Comparative Example 10 | L | 69 | 10 | 110 | 10 | 8 | 0.8 |
| Comparative Example 11 | M | 73 | 3 | 110 | 10 | 8 | 0.8 |
| Comparative Example 12 | N | 63 | 3 | 83 | 10 | 35 | 0.1 |

TABLE 5-continued

| | | Ester wax | | Crystalline polyester | | Hydrophobic silica | |
|---|---|---|---|---|---|---|---|
| | Used wax | Melting point (° C.) | Addition amount (%) | Melting point (° C.) | Addition amount (%) | Particle diameter (nm) | Addition amount (%) |
| Comparative Example 13 | N | 63 | 10 | 110 | 15 | 8 | 1 |
| Comparative Example 14 | O | 67 | 10 | 110 | 15 | 8 | 0.8 |
| Comparative Example 15 | O | 67 | 5 | 110 | 15 | 8 | 0.8 |
| Comparative Example 16 | P | 79 | 6 | 110 | 10 | 20 | 0.8 |
| Comparative Example 17 | A | 68 | 15 | Not added | 0 | 8 | 0.3 |
| Comparative Example 18 | E | 61 | 10 | Not added | 0 | 30 | 1 |

0.5 g of each of the toners of Examples and Comparative Examples was weighed and put into an Erlenmeyer flask. To the Erlenmeyer flask, 2 mL of methylene chloride was added to dissolve the toner therein. Further, 4 mL of hexane was added thereto, an insoluble matter was filtered off, and the solvent was distilled off in a nitrogen gas stream. The resulting deposit was subjected to FD/MS measurement in the same manner as in the case of a simple material of the wax. The obtained results are summarized in the following Tables 6 and 7.

The proportion of the ester compound having a carbon number of (Cn) showing the maximum intensity ratio is represented by (a), and the sum of the content (b) of the ester compound having a carbon number of (Cn-4) and the content (c) of the ester compound having a carbon number of (Cn-2) is represented by (d) and the ratio (d/a) and the ratio (c/a) were determined. Further, the sum of the content (e) of the ester compound having a carbon number of (Cn+2) and the content (f) of the ester compound having a carbon number of (Cn+4) is represented by (g), and the ratio (g/a) was determined. The obtained results are summarized in the following Tables 6 and 7 together with the proportion of the ester compounds having a carbon number of 38 or less.

TABLE 6

| | | Ester wax extracted from toner | | | | |
|---|---|---|---|---|---|---|
| | Used wax | Proportion of ester compound having carbon number showing maximum intensity (%) | Proportion of ester compounds having carbon number of 38 or less (%) | d/a | c/a | g/a |
| Example 1 | A | 40.6 | 9.7 | 0.78 | 0.517 | 0.197 |
| Example 2 | A | 40.7 | 9.5 | 0.782 | 0.518 | 0.198 |
| Example 3 | A | 40.9 | 9.5 | 0.779 | 0.515 | 0.195 |
| Example 4 | A | 40.4 | 9.6 | 0.78 | 0.515 | 0.199 |
| Example 5 | A | 40.7 | 9.8 | 0.78 | 0.515 | 0.199 |
| Example 6 | A | 40.6 | 9.7 | 0.78 | 0.517 | 0.197 |
| Example 7 | B | 54.8 | 3.5 | 0.681 | 0.456 | 0.07 |
| Example 8 | B | 54.6 | 3.8 | 0.68 | 0.455 | 0.065 |
| Example 9 | B | 54.5 | 3.7 | 0.682 | 0.457 | 0.067 |
| Example 10 | B | 54.8 | 3.9 | 0.682 | 0.457 | 0.07 |
| Example 11 | C | 49.8 | 8.8 | 0.626 | 0.282 | 0.188 |
| Example 12 | C | 49.6 | 8.6 | 0.622 | 0.283 | 0.185 |
| Example 13 | C | 49.9 | 8.7 | 0.622 | 0.284 | 0.189 |
| Example 14 | C | 50.3 | 8.8 | 0.623 | 0.281 | 0.187 |
| Example 15 | D | 25.4 | 9.8 | 0.783 | 0.313 | 0.199 |
| Example 16 | D | 25.7 | 9.6 | 0.783 | 0.312 | 0.197 |
| Example 17 | D | 25.6 | 9.5 | 0.782 | 0.312 | 0.199 |
| Example 18 | E | 21.9 | 9.9 | 0.699 | 0.514 | 0.199 |
| Example 19 | E | 21.3 | 9.6 | 0.701 | 0.514 | 0.198 |
| Example 20 | E | 21.6 | 9.9 | 0.698 | 0.516 | 0.197 |
| Example 21 | F | 25.6 | 9.8 | 0.722 | 0.514 | 0.195 |
| Example 22 | F | 25.4 | 9.9 | 0.721 | 0.513 | 0.195 |
| Example 23 | F | 25.3 | 9.7 | 0.723 | 0.514 | 0.194 |
| Example 24 | G | 54.8 | 8.8 | 0.625 | 0.465 | 0.178 |
| Example 25 | G | 54.7 | 9 | 0.627 | 0.463 | 0.175 |
| Example 26 | G | 54.6 | 8.7 | 0.625 | 0.464 | 0.178 |

TABLE 7

| | Used wax | Ester wax extracted from toner: Proportion of ester compound having carbon number showing maximum intensity (%) | Proportion of ester compounds having carbon number of 38 or less (%) | d/a | c/a | g/a |
|---|---|---|---|---|---|---|
| Comparative Example 1 | H | 68.4 | 1.2 | 0.406 | 0.258 | 0.055 |
| Comparative Example 2 | H | 67.8 | 0.7 | 0.405 | 0.262 | 0.057 |
| Comparative Example 3 | I | 40.2 | 12.3 | 1.021 | 0.675 | 0.178 |
| Comparative Example 4 | I | 40.4 | 12.1 | 1.019 | 0.676 | 0.175 |
| Comparative Example 5 | J | 18.1 | 33.6 | 1.507 | 0.508 | 1.07 |
| Comparative Example 6 | J | 18.2 | 34.2 | 1.509 | 0.505 | 1.05 |
| Comparative Example 7 | K | 100 | 100 | 0 | 0 | 0 |
| Comparative Example 8 | L | 52.4 | 0.2 | 0.398 | 0.294 | 0.47 |
| Comparative Example 9 | L | 52.4 | 0.6 | 0.399 | 0.296 | 0.471 |
| Comparative Example 10 | L | 52.5 | 0.5 | 0.401 | 0.295 | 0.47 |
| Comparative Example 11 | M | 100 | 0 | 0 | 0 | 0 |
| Comparative Example 12 | N | 20.1 | 6.9 | 1.835 | 0.938 | 1.74 |
| Comparative Example 13 | N | 19.8 | 7.2 | 1.837 | 0.935 | 1.73 |
| Comparative Example 14 | O | 44.9 | 5.9 | 0.791 | 0.524 | 0.244 |
| Comparative Example 15 | O | 45.4 | 6 | 0.79 | 0.523 | 0.245 |
| Comparative Example 16 | P | 19.9 | 0 | 1.835 | 0.899 | 1.25 |
| Comparative Example 17 | A | 40.4 | 9.5 | 0.782 | 0.517 | 0.198 |
| Comparative Example 18 | E | 21.8 | 9.8 | 0.7 | 0.514 | 0.199 |

With respect to each toner, the low-temperature fixability, storage stability, property of long service life, and toner Tg were determined. The evaluation methods are as follows.

Low-Temperature Fixability

The fixing system of commercially available e-studio 6530c (manufactured by TOSHIBA TEC CORPORATION) was modified so that the set temperature can be incremented or decremented by 0.1° C. between 100° C. and 200° C. The initial temperature was set to 150° C., and a solid image at a toner deposition amount of 1.5 mg/cm$^2$ was formed on 10 sheets of paper. When not the slightest image peeling due to offset or an unfixed toner occurred on the 10 sheets of paper, the set temperature was decreased, and the lower limit of the fixing temperature at which image peeling did not occur was determined. The fixing temperature is preferably lower, and a case where the fixing temperature was higher than 125° C. was evaluated as "NG". In the case of each of the toners of Examples, the fixing temperature was lower than 125° C.

Storage Stability 15 g of each toner was left at 55° C. for 10 hours, and then, sieved through a mesh. The toner remaining on the mesh was weighed. The amount of the toner remaining on the mesh is preferably smaller, and a case where the amount was more than 3 g was evaluated as "NG". In the case of each of the toners of Examples, the amount of the toner remaining on the mesh was less than 3 g.

Property of Long Service Life

The property of long service life is determined based on a toner scattering amount in the image forming apparatus after printing is carried out on a predetermined number of sheets of paper. By using commercially available e-studio 6530c (manufactured by TOSHIBA TEC CORPORATION), an original document with a coverage rate of 8.0% was continuously copied on 300,000 sheets of A4 paper. At this time, the toner accumulated in a lower part of a magnet roller of the developing device was sucked by a cleaner, and the weight of the amount of the accumulated toner (toner scattering amount) was measured, whereby the toner scattering amount was determined. As the toner scattering amount is smaller, the members in the main body are less fouled, and therefore, the property of long service life is excellent, and a case where the toner scattering amount was more than 170 mg was evaluated as "NG". In the case of each of the developers of Examples, the toner scattering amount was less than 170 mg.

Toner Tg

The measurement is carried out using DSC (DSC Q2000, manufactured by TA INSTRUMENTS, INC.) under the following conditions: sample amount: 5 mg, lid and pan: made of alumina, temperature raising rate: 10° C./min, measurement temperature: 20 to 200° C. The sample heated to 200° C. is cooled to 20° C. or lower. Then, the sample is heated again, and the measurement is carried out, and the thus obtained data is used. Tangents are drawn on the low temperature side and the high temperature side of a curve generated in a temperature range from around 30° C. to 60° C., and the point of intersection of the extension lines thereof is defined as Tg.

A lower toner Tg is advantageous to the low-temperature fixation, however, if the toner Tg is too low, the storage stability is deteriorated. Although 33° C. is an indication deduced from the evaluation results, a case where the toner Tg was lower than 33° C. resulted in "NG".

The obtained evaluation results are summarized in the following Tables 8 and 9.

TABLE 8

| | Low-temperature fixability | Storage stability | Property of long service life (toner scattering) | Toner Tg |
|---|---|---|---|---|
| Example 1 | Good (113° C.) | Good (1.9 g) | Good (150 mg) | 33.4 |
| Example 2 | Good (121° C.) | Good (0.6 g) | Good (100 mg) | 43.4 |
| Example 3 | Good (115° C.) | Good (0.5 g) | Good (110 mg) | 33.9 |
| Example 4 | Good (114° C.) | Good (2.0 g) | Good (145 mg) | 33.5 |
| Example 5 | Good (122° C.) | Good (0.5 g) | Good (100 mg) | 44.9 |
| Example 6 | Good (113° C.) | Good (0.3 g) | Good (110 mg) | 33.4 |
| Example 7 | Good (123° C.) | Good (0.4 g) | Good (110 mg) | 43.2 |
| Example 8 | Good (124° C.) | Good (0.5 g) | Good (120 mg) | 43.6 |
| Example 9 | Good (118° C.) | Good (2.8 g) | Good (160 mg) | 34.8 |

TABLE 8-continued

| | Low-temperature fixability | Storage stability | Property of long service life (toner scattering) | Toner Tg |
|---|---|---|---|---|
| Example 10 | Good (118° C.) | Good (2.7 g) | Good (155 mg) | 34.6 |
| Example 11 | Good (123° C.) | Good (0.3 g) | Good (80 mg) | 45 |
| Example 12 | Good (124° C.) | Good (0.1 g) | Good (90 mg) | 45 |
| Example 13 | Good (123° C.) | Good (0.3 g) | Good (90 mg) | 44.8 |
| Example 14 | Good (122° C.) | Good (0.1 g) | Good (70 mg) | 44.7 |
| Example 15 | Good (111° C.) | Good (2.4 g) | Good (170 mg) | 33.2 |
| Example 16 | Good (113° C.) | Good (2.0 g) | Good (160 mg) | 33.5 |
| Example 17 | Good (120° C.) | Good (0.7 g) | Good (105 mg) | 44.7 |
| Example 18 | Good (120° C.) | Good (1.1 g) | Good (130 mg) | 36.7 |
| Example 19 | Good (114° C.) | Good (2.6 g) | Good (150 mg) | 33.6 |
| Example 20 | Good (125° C.) | Good (0.7 g) | Good (100 mg) | 43.2 |
| Example 21 | Good (118° C.) | Good (0.8 g) | Good (120 mg) | 36.7 |
| Example 22 | Good (116° C.) | Good (1.3 g) | Good (135 mg) | 35 |
| Example 23 | Good (123° C.) | Good (0.9 g) | Good (120 mg) | 43.1 |
| Example 24 | Good (120° C.) | Good (0.3 g) | Good (80 mg) | 44.5 |
| Example 25 | Good (113° C.) | Good (2.7 g) | Good (165 mg) | 33.6 |
| Example 26 | Good (117° C.) | Good (2.3 g) | Good (150 mg) | 39.8 |

TABLE 9

| | Low-temperature fixability | Storage stability | Property of long service life (toner scattering) | Toner Tg |
|---|---|---|---|---|
| Comparative Example 1 | Good (117° C.) | Bad (6.7 g) | Bad (200 mg) | 35.2 |
| Comparative Example 2 | Bad (127° C.) | Bad (3.2 g) | Bad (180 mg) | 44.2 |
| Comparative Example 3 | Good (113° C.) | Bad (10.8 g) | Bad (330 mg) | 30.1 |
| Comparative Example 4 | Bad (140° C.) | Good (1.0 g) | Good (160 mg) | 57.5 |
| Comparative Example 5 | Good (115° C.) | Bad (7.6 g) | Bad (205 mg) | 36.4 |
| Comparative Example 6 | Good (125° C.) | Bad (5.5 g) | Bad (175 mg) | 42.1 |
| Comparative Example 7 | Good (120° C.) | Bad (lump, 15 g) | Bad (400 mg) | 36.1 |
| Comparative Example 8 | Bad (145° C.) | Good (0.1 g) | Good (50 mg) | 55.6 |
| Comparative Example 9 | Bad (130° C.) | Good (1.5 g) | Good (170 mg) | 44.7 |
| Comparative Example 10 | Bad (128° C.) | Bad (3.1 g) | Bad (180 mg) | 42.7 |
| Comparative Example 11 | Good (125° C.) | Bad (6.2 g) | Bad (180 mg) | 45.6 |
| Comparative Example 12 | Good (122° C.) | Bad (5.6 g) | Bad (240 mg) | 40.6 |
| Comparative Example 13 | Good (117° C.) | Bad (4.6 g) | Bad (180 mg) | 32.7 |
| Comparative Example 14 | Good (117° C.) | Good (2.8 g) | Bad (360 mg) | 33.5 |
| Comparative Example 15 | Bad (126° C.) | Good (2.2 g) | Bad (330 mg) | 38.7 |
| Comparative Example 16 | Bad (127° C.) | Good (0.1 g) | Good (160 mg) | 45.6 |
| Comparative Example 17 | Bad (145° C.) | Bad (3.5 g) | Good (160 mg) | 54.6 |
| Comparative Example 18 | Bad (140° C.) | Good (0.1 g) | Good (70 mg) | 56.5 |

The ester waxes used in Examples have unprecedentedly excellent low-temperature fixability and are hardly deposited when being left under a high temperature environment. It is found that by forming toner particles using such an ester wax and a crystalline polyester resin having favorable low-temperature fixability in combination, and combining these toner particles with an additive having a specific size, fixation can be achieved at a lower temperature than in the past, and a toner which can achieve both of the storage stability and the prolongation of the service life can be obtained.

Each of the developers of Examples has two melting points: one is derived from the crystalline polyester and the other is derived from the ester wax. Further, in the ester wax to be used, the distribution around the maximum intensity ratio is also specified. Owing to this, the dispersion of the wax in the toner becomes further favorable, and thus, the toner Tg can be decreased as compared with the case of using a common ester wax. According to this embodiment, the fixability becomes favorable also at a low temperature.

As a disadvantage of using the crystalline polyester resin and the ester wax at the same time, the storage stability is deteriorated, or the toner contaminates the carrier surface so that the chargeability during the service life tends to be deteriorated. On the other hand, the developer according to the embodiment is configured such that an additive having a relatively small particle diameter is added to the surfaces of the toner particles, and therefore, the fluidity of the developer can be maintained, and thus, all of the low-temperature fixability, the storage stability, and the prolongation of the service life are achieved.

On the other hand, the toners of Comparative Examples cannot achieve all of the low-temperature fixability, the storage stability, and the prolongation of the service life at the same time.

The ester wax (H) used in Comparative Example 1 is configured such that the content of the ester compound having a carbon number showing the maximum intensity ratio exceeds 55% by weight, and also the ratio (g/a) is less than 0.065. Since the distribution of carbon numbers is sharp, the dispersibility of the wax is poor and the wax is deposited, and therefore, the storage stability is deteriorated.

The ester wax (H) used in Comparative Example 2 is configured such that the content of the ester compound having a carbon number showing the maximum intensity ratio exceeds 55% by weight and the ratio (g/a) is less than 0.065 in the same manner as in Comparative Example 1. Due to this, the dispersibility of the wax is poor and the wax is deposited, and therefore, the storage stability is poor. Moreover, the ratio (d/a) is less than 0.619, and therefore, the fixability is poor.

The ester wax (I) used in Comparative Example 3 is configured such that the content of the ester compounds having a carbon number of 38 or less exceeds 10% by weight. Due to this, the dispersibility of the wax is poor and the wax is deposited, and therefore, the storage stability is poor.

In the case of Comparative Example 4, the ester wax (I) is used, and also a crystalline polyester is not contained, and therefore, the Tg is high, and thus, the fixability is poor.

The ester wax (J) used in Comparative Example 5 is configured such that the content of the ester compound having a carbon number showing the maximum intensity ratio is less than 20% by weight, and also the content of the ester compounds having a carbon number of 38 or less is high, and moreover, the ratio (g/a) exceeds 0.200. Due to this, the wax is deposited, and therefore, the storage stability is poor.

In the case of Comparative Example 6, the ester wax (J) is used, and therefore, the storage stability is poor.

The ester wax (K) used in Comparative Example 7 is configured such that the content of the ester compounds having a carbon number of 38 or less is high. Due to this, the wax is deposited, and therefore, the storage stability is poor and also the toner scattering occurs significantly.

The ester wax (L) used in Comparative Examples 8 to 10 is configured such that the ratio (g/a) exceeds 0.200. Due to this, the fixation cannot be achieved at a low temperature. In particular, in the case of Comparative Example 8 in which a crystalline polyester is not contained, the fixing temperature is as high as 145° C.

The ester wax (M) used in Comparative Example 11 is configured such that the content of the ester compound having a carbon number showing the maximum intensity ratio is 100% and therefore, the distribution is extremely sharp. Due to this, the wax is deposited, and therefore, the storage stability is poor.

The ester wax (N) used in Comparative Examples 12 and 13 is configured such that the ratio (g/a) exceeds 0.200. Due to this, the fluidity is deteriorated, and the property of long service life is poor.

The ester wax (O) used in Comparative Examples 14 and 15 is configured such that the ratio (g/a) exceeds 0.200. Due to this, the fluidity is deteriorated, and the property of long service life is poor. In particular, in the case of Comparative Examples 15, the fixability is also poor.

The ester wax (P) used in Comparative Example 16 is rice wax, and is configured such that the carbon number showing the maximum intensity ratio is larger than 48, and the ratio (g/a) exceeds 0.200. Due to this, the fixability is poor.

According to Comparative Examples 17 and 18, it is found that when a crystalline polyester resin is not contained, the fixability is poor.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner, comprising:

a coloring agent;

an amorphous polyester;

a crystalline polyester having an endothermic peak temperature of T2 as measured by a differential scanning calorimeter;

ester wax having an endothermic peak temperature of T1 as measured by a differential scanning calorimeter (provided that T1<T2) and containing multiple ester compounds, each having a carbon number selected from 32 to 54, and hydrophobic silica having an average primary particle diameter of 8 to 35 nm, wherein when the ion intensity ratio of each ester compound having a different carbon number is expressed as percentage, the content (a) of the ester compound having a carbon number of (Cn) selected from group consisting of 42, 44, and 46, the carbon number of (Cn) showing the maximum intensity ratio, is from 20 to 55% by weight of the entire ester wax, the sum (g) of the content (e) of the ester compound having a carbon number of (Cn+2) and the content (f) of the ester compound having a carbon number of (Cn+4) satisfies the following formula: $0.065 \leq g/a \leq 0.200$, and the multiple ester compounds include the ester compound having the carbon number of (Cn) and three or more and six or less ester compounds each having a carbon number greater than the carbon number of (Cn).

2. The toner according to claim 1, wherein the endothermic peak temperature (T2) of the crystalline polyester as measured by a differential scanning calorimeter is from 85 to 110° C., and the endothermic peak temperature (T1) of the ester wax as measured by a differential scanning calorimeter is from 60 to 75° C.

3. The toner according to claim 1, wherein the ester wax accounts for 3 to 12% by weight of the toner particles, and the crystalline polyester accounts for 3 to 20% by weight of the toner particles.

4. The toner according to claim 1, wherein in the ester wax, the content (c) of the ester compound having a carbon number of (Cn-2) satisfies the following formula: $0.281 \leq c/a \leq 0.518$.

5. The toner according to claim 1, wherein the hydrophobic silica is in a non-spherical shape, and is contained in an amount of 0.2 to 0.8% by weight of the toner particles.

6. The toner according to claim 1, wherein the content of the ester compounds having a carbon number of 38 or less is 10% by weight or less of the entire ester wax.

7. An image forming apparatus comprising:

a photoconductor drum;

an electrifying charger configured to charge a surface of the photoconductive drum;

a laser unit configured to form an electrostatic latent image on a surface of the photoconductor drum;

a developing unit including a developing vessel and the toner according to claim 1 placed in the developing vessel, the developing unit is configured to develop the electrostatic latent image with the toner to form a toner image on the surface of the photoconductor drum;

a transferring charger configured to transfer the toner image from the surface onto a paper;

a fixing roller pair to which the paper having the toner image is conveyed; and a cleaning device configured to remove a residual toner on the photoconductor drum.

8. A toner container comprising:

the toner according to claim 1; and a container containing the toner.

* * * * *